US007606666B2

(12) United States Patent
Repin et al.

(10) Patent No.: US 7,606,666 B2
(45) Date of Patent: Oct. 20, 2009

(54) SYSTEM AND METHOD FOR PERFORMING OILFIELD DRILLING OPERATIONS USING VISUALIZATION TECHNIQUES

(75) Inventors: Dmitriy Repin, Katy, TX (US); Vivek Singh, Houston, TX (US); Clinton Chapman, Missouri City, TX (US); James Brannigan, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 9 days.

(21) Appl. No.: 12/021,258

(22) Filed: Jan. 28, 2008

(65) Prior Publication Data

US 2008/0179094 A1 Jul. 31, 2008

Related U.S. Application Data

(60) Provisional application No. 60/897,942, filed on Jan. 29, 2007, provisional application No. 60/920,014, filed on Mar. 26, 2007.

(51) Int. Cl.
*G06F 19/00* (2006.01)
*E21B 47/00* (2006.01)

(52) U.S. Cl. ..... 702/9; 175/50

(58) Field of Classification Search ..... 702/9, 702/11, 16; 703/1, 10; 175/50
See application file for complete search history.

(56) References Cited

U.S. PATENT DOCUMENTS

| | | | |
|---|---|---|---|
| 5,139,094 | A | 8/1992 | Prevedel et al. |
| 5,680,906 | A | 10/1997 | Andrieux et al. |
| 5,899,958 | A | 5/1999 | Dowell et al. |
| 5,992,519 | A | 11/1999 | Ramakrishnan et al. |
| 6,266,619 | B1 | 7/2001 | Thomas et al. |
| 6,313,837 | B1 | 11/2001 | Assa et al. |
| 6,801,197 | B2 | 10/2004 | Sanstrom |
| 6,975,112 | B2 | 12/2005 | Morys et al. |
| 6,980,940 | B1 | 12/2005 | Gurpinar et al. |
| 7,003,439 | B2 | 2/2006 | Aldred et al. |
| 7,079,952 | B2 | 7/2006 | Thomas et al. |
| 2003/0132934 | A1 | 7/2003 | Fremming |

(Continued)

FOREIGN PATENT DOCUMENTS

| | | |
|---|---|---|
| GB | 2392931 | 3/2004 |

(Continued)

OTHER PUBLICATIONS

International Search Report from International Application No. PCT/US2008/052360, dated Jun. 4, 2008, 3 pages.

(Continued)

*Primary Examiner*—Bryan Bui
(74) *Attorney, Agent, or Firm*—Bryan P. Galloway; Osha Liang LLP

(57) ABSTRACT

The invention relates to a method of performing a drilling operation for an oilfield. The method includes collecting oilfield data, a portion of the oilfield data being real-time drilling data generated from the oilfield during drilling, defining a number of oilfield events based on the oilfield data, selectively displaying the number of oilfield events in proximity of a wellbore image of a display, updating the display of the number of oilfield events during drilling based on the real-time drilling data.

14 Claims, 14 Drawing Sheets

U.S. PATENT DOCUMENTS

| | | | |
|---|---|---|---|
| 2003/0216897 | A1 | 11/2003 | Endres et al. |
| 2003/0220742 | A1 | 11/2003 | Niedermayr et al. |
| 2004/0040746 | A1 | 3/2004 | Niedermayr et al. |
| 2004/0111216 | A1 | 6/2004 | Kneissl et al. |
| 2004/0220846 | A1 | 11/2004 | Cullick et al. |
| 2005/0149307 | A1 | 7/2005 | Gurpinar et al. |
| 2005/0209836 | A1 | 9/2005 | Klumpen et al. |
| 2005/0209886 | A1 | 9/2005 | Corkern |
| 2005/0211468 | A1 | 9/2005 | Veeningen et al. |
| 2005/0228905 | A1 | 10/2005 | Veeningen et al. |
| 2005/0236184 | A1 | 10/2005 | Veeningen et al. |
| 2006/0197759 | A1 | 9/2006 | Fremming |
| 2007/0112547 | A1 | 5/2007 | Ghorayeb et al. |
| 2008/0172272 | A1* | 7/2008 | Back et al. ..... 705/7 |

FOREIGN PATENT DOCUMENTS

| | | |
|---|---|---|
| GB | 2411669 | 9/2005 |
| WO | 9964896 | 12/1999 |
| WO | 2004049216 | 6/2004 |

OTHER PUBLICATIONS

Written Opinion from International Application No. PCT/US2008/052360, dated Jun. 4, 2008, 3 pages.

* cited by examiner

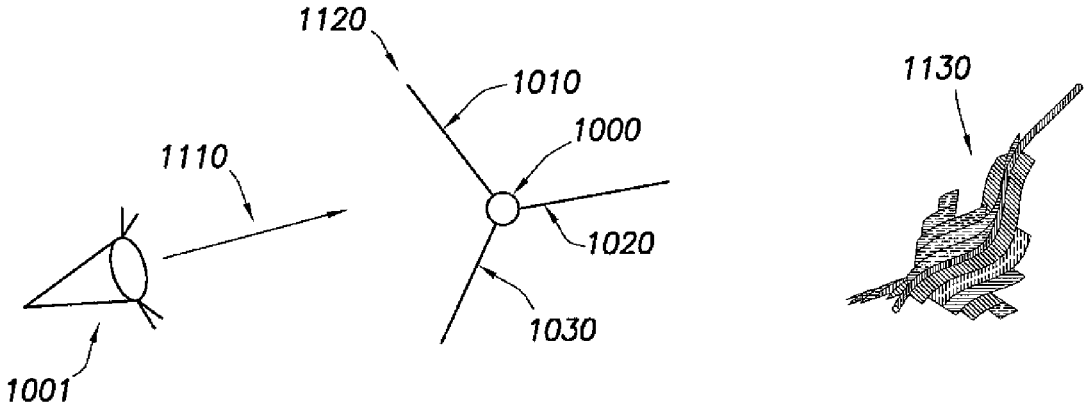
FIG. 10A
FIG. 10B
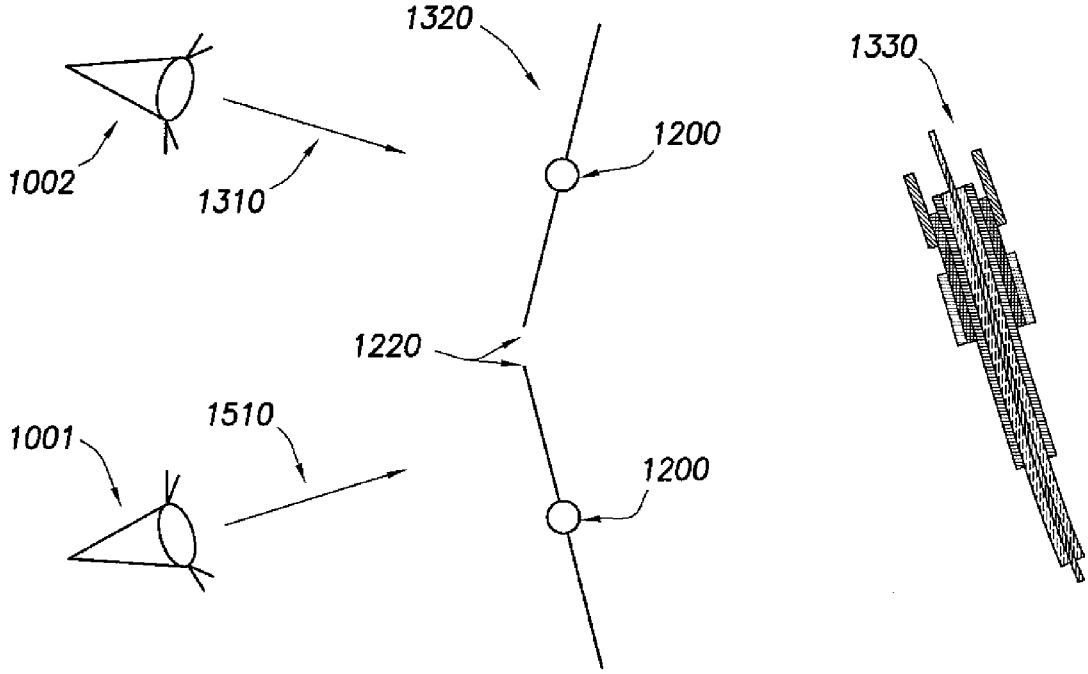

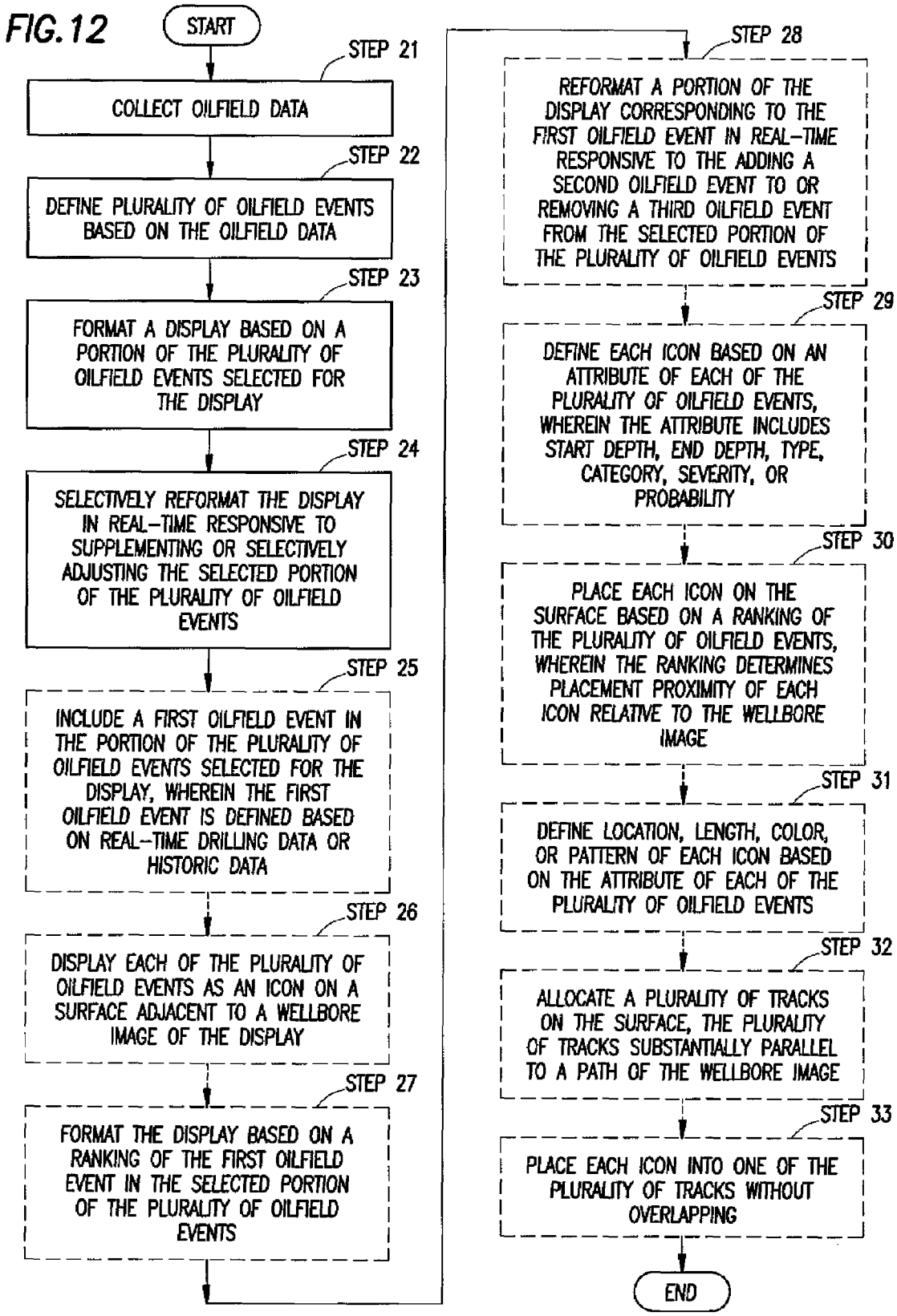
FIG. 12
START
STEP 21
COLLECT OILFIELD DATA
STEP 22
DEFINE PLURALITY OF OILFIELD EVENTS BASED ON THE OILFIELD DATA
STEP 23
FORMAT A DISPLAY BASED ON A PORTION OF THE PLURALITY OF OILFIELD EVENTS SELECTED FOR THE DISPLAY
STEP 24
SELECTIVELY REFORMAT THE DISPLAY IN REAL-TIME RESPONSIVE TO SUPPLEMENTING OR SELECTIVELY ADJUSTING THE SELECTED PORTION OF THE PLURALITY OF OILFIELD EVENTS
STEP 25
INCLUDE A FIRST OILFIELD EVENT IN THE PORTION OF THE PLURALITY OF OILFIELD EVENTS SELECTED FOR THE DISPLAY, WHEREIN THE FIRST OILFIELD EVENT IS DEFINED BASED ON REAL-TIME DRILLING DATA OR HISTORIC DATA
STEP 26
DISPLAY EACH OF THE PLURALITY OF OILFIELD EVENTS AS AN ICON ON A SURFACE ADJACENT TO A WELLBORE IMAGE OF THE DISPLAY
STEP 27
FORMAT THE DISPLAY BASED ON A RANKING OF THE FIRST OILFIELD EVENT IN THE SELECTED PORTION OF THE PLURALITY OF OILFIELD EVENTS
STEP 28
REFORMAT A PORTION OF THE DISPLAY CORRESPONDING TO THE FIRST OILFIELD EVENT IN REAL-TIME RESPONSIVE TO THE ADDING A SECOND OILFIELD EVENT TO OR REMOVING A THIRD OILFIELD EVENT FROM THE SELECTED PORTION OF THE PLURALITY OF OILFIELD EVENTS
STEP 29
DEFINE EACH ICON BASED ON AN ATTRIBUTE OF EACH OF THE PLURALITY OF OILFIELD EVENTS, WHEREIN THE ATTRIBUTE INCLUDES START DEPTH, END DEPTH, TYPE, CATEGORY, SEVERITY, OR PROBABILITY
STEP 30
PLACE EACH ICON ON THE SURFACE BASED ON A RANKING OF THE PLURALITY OF OILFIELD EVENTS, WHEREIN THE RANKING DETERMINES PLACEMENT PROXIMITY OF EACH ICON RELATIVE TO THE WELLBORE IMAGE
STEP 31
DEFINE LOCATION, LENGTH, COLOR, OR PATTERN OF EACH ICON BASED ON THE ATTRIBUTE OF EACH OF THE PLURALITY OF OILFIELD EVENTS
STEP 32
ALLOCATE A PLURALITY OF TRACKS ON THE SURFACE, THE PLURALITY OF TRACKS SUBSTANTIALLY PARALLEL TO A PATH OF THE WELLBORE IMAGE
STEP 33
PLACE EACH ICON INTO ONE OF THE PLURALITY OF TRACKS WITHOUT OVERLAPPING
END

SYSTEM AND METHOD FOR PERFORMING OILFIELD DRILLING OPERATIONS USING VISUALIZATION TECHNIQUES

CROSS REFERENCE TO RELATED APPLICATIONS

This application claims priority under 35 U.S.C. §119 from Provisional Patent Application No. 60/897,942 filed Jan. 29, 2007 and Provisional Patent Application No. 60/920,014 filed Mar. 26, 2007.

BACKGROUND OF THE INVENTION

1. Field of the Invention

The present invention relates to techniques for performing oilfield operations relating to subterranean formations having reservoirs therein. More particularly, the invention relates to techniques for performing drilling operations involving an analysis of drilling equipment, drilling conditions and other oilfield parameters that impact the drilling operations.

2. Background of the Related Art

Oilfield operations, such as surveying, drilling, wireline testing, completions and production, are typically performed to locate and gather valuable downhole fluids. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing. Throughout this document, the term "wellbore" is used interchangeably with the term "borehole."

After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipment may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to formation structure and geological stratigraphy that defines the geological structure of the subterranean formation. Dynamic data relates to fluids flowing through the geologic structures of the subterranean formation. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples are used to take physical specimens of the formation at various depths as shown in FIG. 1B. Well logging involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure and composition may be monitored. These parameters may be used to determine various characteristics of the subterranean formation.

Sensors may be positioned about the oilfield to collect data relating to various oilfield operations. For example, sensors in the wellbore may monitor fluid composition, sensors located along the flow path may monitor flow rates and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other configurations. Often this information is used to determine when to drill new wells, re-complete existing wells or alter wellbore production.

Data from one or more wellbores may be analyzed to plan or predict various outcomes at a given wellbore. In some cases, the data from neighboring wellbores, or wellbores with similar conditions or equipment is used to predict how a well will perform. There are usually a large number of variables and large quantities of data to consider in analyzing wellbore operations. It is, therefore, often useful to model the behavior of the oilfield operation to determine the desired course of action. During the ongoing operations, the operating conditions may need adjustment as conditions change and new information is received.

Techniques have been developed to model the behavior of geological structures, downhole reservoirs, wellbores, surface facilities as well as other portions of the oilfield operation. Examples of modeling techniques are shown in patent/application Nos. U.S. Pat. No. 5,992,519, WO2004049216, WO1999/064896, U.S. Pat. No. 6,313,837, US2003/0216897, US2003/0132934, US20050149307 and US2006/0197759. Typically, existing modeling techniques have been used to analyze only specific portions of the oilfield operation. More recently, attempts have been made to use more than one model in analyzing certain oilfield operations. See, for example, U.S. patent/application Nos. U.S. Pat. No. 5,698,0940, WO04049216, 20040220846, Ser. No. 10/586,283, and U.S. Pat. No. 6,801,197.

Techniques have also been developed to predict and/or plan certain oilfield operations, such as drilling operations. Examples of techniques for generating drilling plans are provided in U.S. Patent/Application Nos. 20050236184, 20050211468, 20050228905, 20050209886, and 20050209836. Some drilling techniques involve controlling the drilling operation. Examples of such drilling techniques are shown in Patent/Application Nos. GB2392931 and GB2411669. Other drilling techniques seek to provide real-time drilling operations. Examples of techniques purporting to provide real-time drilling are described in U.S. Paten/application Nos. 7,079,952, 6,266,619, 5,899,958, 5,139,094, 7,003,439 and 5,680,906.

Despite the development and advancement of various aspects of oilfield planning, there remains a need to provide techniques capable of designing and implementing drilling operations based on a complex analysis of a wide variety of parameters affecting oilfield operations. It is desirable that such a complex analysis of oilfield parameters and their impact on the drilling operation be performed in real-time. It is further desirable that such techniques enable real-time data flow to and/or from a variety of sources (i.e. internal and/or external). Such techniques preferably would be capable of one of more of the following, among others: selectively manipulating data to facilitate data flow, automatically and/or manually translating and/or converting the data, providing visualization of data and/or outputs, selectively accessing a given number of a variety of servers, selectively accessing data flow channels, providing integrated processing of selected data in a single operation, enabling direct access to real-time data sources without requiring intermediaries, displaying data and/or outputs in one or more canvases (such as 2D, 3D, Well Section), processing a wide variety of data of various formats, implementing (in an automatic, manual, real-time or other fashion) drilling commands based on data, updating displays of drilling data (locally or remotely) and the earth model as new data is acquired from downhole instruments or based upon the data stored in the servers, and automatically and/or manually tuning the rendering of the live and historical data in other contexts (such as geological, geophysical) in a manner that meets/exceeds the performance needs.

Identifying the risks associated with drilling a well is probably the most subjective process in well planning today. This is based on a person recognizing part of a technical well design that is out of place relative to the earth properties or mechanical equipment to be used to drill the well. The identification of any risks is brought about by integrating all of the well, earth, and equipment information in the mind of a person and mentally sifting through all of the information, mapping the interdependencies, and based solely on personal experience extracting which parts of the project pose what potential risks to the overall success of that project. This is tremendously sensitive to human bias, the individual's ability to remember and integrate all of the data in their mind, and the individuals experience to enable them to recognize the conditions that trigger each drilling risk. Most people are not equipped to do this and those that do are very inconsistent unless strict process and checklists are followed. Some drilling risk software systems are in existence today, but the same human process in required to identify and assess the likelihood of each individual risk and the consequences. Those systems are simply a computer system for manually recording the results of the risk identification process.

Conventional software systems for automatic well planning may include a risk assessment component. This component automatically assesses risks associated with the technical well design decisions in relation to the earth's geology and geomechanical properties and in relation to the mechanical limitations of the equipment specified or recommended for use.

When users have identified and captured drilling risks for drilling a given well, no prescribed standard visualization techniques exist to add value to the risk information already created. Some techniques exist for locating an individual risk event at a specified measured depth or depth interval by using some type of symbol or shape and pattern combination in a three-dimensional (3D) space.

SUMMARY OF THE INVENTION

In at least one aspect, the invention relates to a method of performing a drilling operation for an oilfield having a subterranean formation with geological structures and reservoirs therein. The method involves collecting oilfield data, selectively manipulating the oilfield data for real-time analysis according to a defined configuration, comparing the real-time drilling data with oilfield predictions based on the defined configuration and selectively adjusting the drilling operation based on the comparison.

In another aspect, the invention relates to a method of performing a drilling operation for an oilfield having drilling system for advancing a drilling tool into a subterranean formation. The method involves collecting oilfield data, a portion of the oilfield data being real-time drilling data generated from the oilfield during drilling, defining a plurality of oilfield events based on the oilfield data, selectively displaying the plurality of oilfield events about a wellbore image of a display, and updating the display of the plurality of oilfield events during drilling based on the real-time drilling data.

In another aspect, the invention relates to a method of performing a drilling operation for an oilfield having drilling system for advancing a drilling tool into a subterranean formation. The method involves collecting oilfield data, a portion of the oilfield data being real-time drilling data generated from the oilfield during drilling, defining a plurality of oilfield events based on the oilfield data, formatting a display based on a portion of the plurality of oilfield events selected for the display, and selectively reformatting the display in real-time responsive to supplementing the selected portion of the plurality of oilfield events or selectively adjusting the selected portion of the plurality of oilfield events.

In another aspect, the invention relates to a computer readable medium, embodying instructions executable by a computer to perform method steps for performing a drilling operation for an oilfield having drilling system for advancing a drilling tool into a subterranean formation. The instructions includes functionality for collecting oilfield data, at least a portion of the oilfield data being generated from a wellsite of the oilfield, selectively manipulating the oilfield data for real-time analysis according to a defined configuration, comparing the real-time drilling data with oilfield predictions based on the defined configuration, and selectively adjusting the drilling operation based on the comparison.

In another aspect, the invention relates to a system for performing a drilling operation for an oilfield having a subterranean formation with geological structures and reservoirs therein. The system is provided with a surface unit for collecting oilfield data and a modeling tool operatively linked to the surface unit. The modeling tool has a plurality of formatting modules for selectively formatting the oilfield data according to a real-time configuration and a plurality of processing modules for selectively analyzing the oilfield data based on the real-time configuration. Other aspects of the invention will be discernible from the disclosure provided herein.

Other aspects and advantages of the invention will be apparent from the following description and the appended claims.

BRIEF DESCRIPTION OF DRAWINGS

FIGS. 7, 8, 9A, 9B, 10A and 10B show exemplary representations of multiple oilfield events in the 3D display.

FIGS. 11 and 12 show flow charts depicting additional methods of performing a drilling operation of an oilfield.

DETAILED DESCRIPTION

Figure 1A:
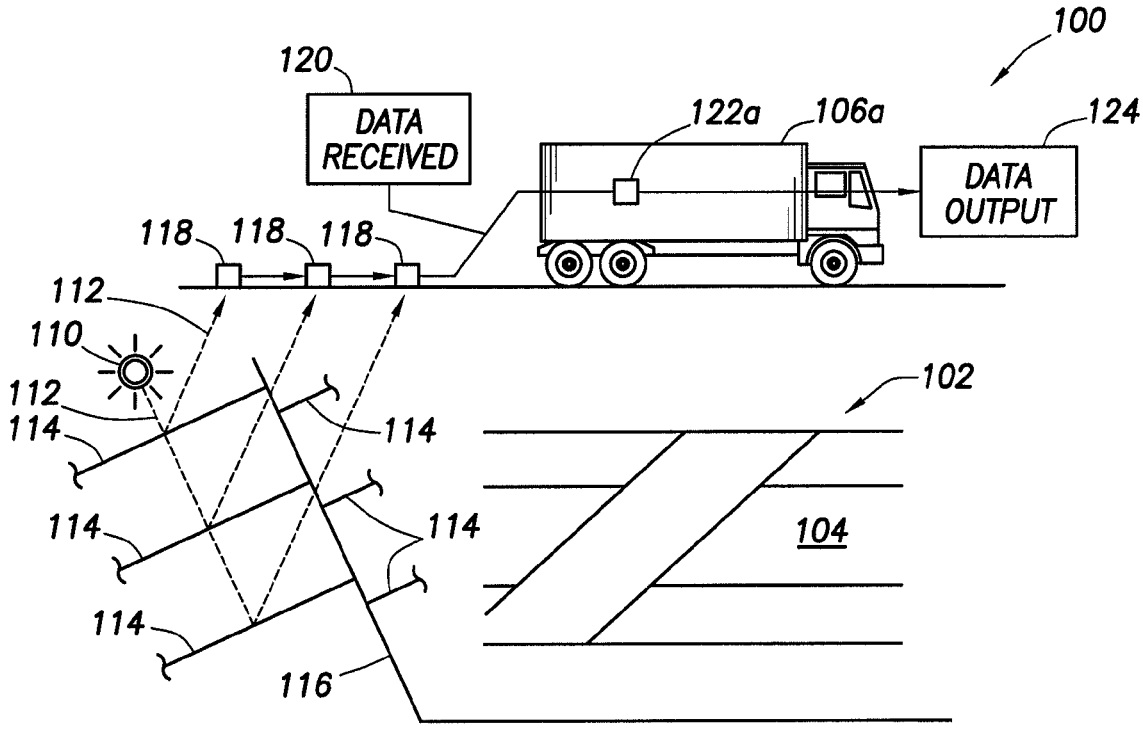
FIG. 1A (Prior Art)
FIGS. 1A-1D depict a schematic view of an oilfield having subterranean structures containing reservoirs therein, various oilfield operations being performed on the oilfield.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. In other instances, well-known features have not been described in detail to avoid obscuring the invention.

In general, the present invention relates generally to the integration of geoscience modeling software and the Well Planning System (WPS) to model and display well bore geometry, drilling parameters, risk quantification, and the time and cost to drill a well in a geological context.

The present invention involves applications generated for the oil and gas industry. FIGS. 1A-1D illustrate an exemplary oilfield (100) with subterranean structures and geological structures therein. More specifically, FIGS. 1A-1D depict schematic views of an oilfield (100) having subterranean structures (102) containing a reservoir (104) therein and depicting various oilfield operations being performed on the oilfield. Various measurements of the subterranean formation are taken by different tools at the same location. These measurements may be used to generate information about the formation and/or the geological structures and/or fluids contained therein.

FIG. 1A depicts a survey operation being performed by a seismic truck (106*a*) to measure properties of the subterranean formation. The survey operation is a seismic survey operation for producing sound vibrations. In FIG. 1A, an acoustic source (110) produces sound vibrations (112) that reflects off a plurality of horizons (114) in an earth formation 116. The sound vibration(s) (112) is (are) received in by sensors, such as geophone-receivers (118), situated on the earth's surface, and the geophones (118) produce electrical output signals, referred to as data received (120) in FIG. 1.

The received sound vibration(s) (112) are representative of different parameters (such as amplitude and/or frequency). The data received (120) is provided as input data to a computer (122*a*) of the seismic recording truck (106*a*), and responsive to the input data, the recording truck computer (122*a*) generates a seismic data output record (124). The seismic data may be further processed as desired, for example by data reduction.

Figure 1B:
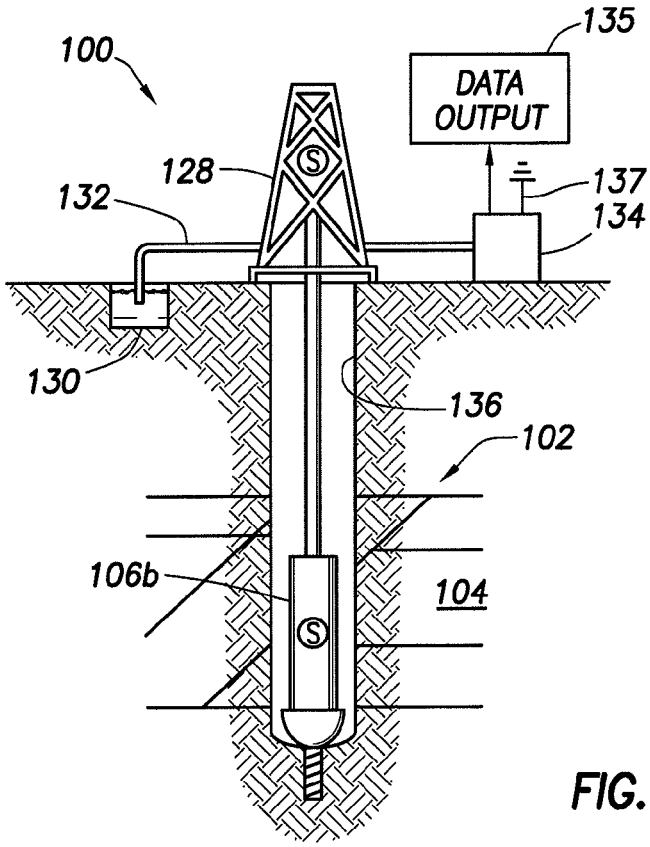
FIG. 1B (Prior Art)

FIG. 1B depicts a drilling operation being performed by a drilling tool 106*b* suspended by a rig (128) and advanced into the subterranean formation (102) to form a wellbore (136). A mud pit (130) is used to draw drilling mud into the drilling tool via flow line (132) for circulating drilling mud through the drilling tool and back to the surface. The drilling tool is advanced into the formation to reach reservoir (104). The drilling tool is preferably adapted for measuring downhole properties. The logging while drilling tool may also be adapted for taking a core sample (133) as shown, or removed so that a core sample may be taken using another tool.

A surface unit (134) is used to communicate with the drilling tool and offsite operations. The surface unit is capable of communicating with the drilling tool to send commands to drive the drilling tool, and to receive data therefrom. The surface unit is preferably provided with computer facilities for receiving, storing, processing and analyzing data from the oilfield. The surface unit collects data output (135) generated during the drilling operation. Computer facilities, such as those of the surface unit, may be positioned at various locations about the oilfield and/or at remote locations.

Sensors (S), such as gauges, may be positioned throughout the reservoir, rig, oilfield equipment (such as the downhole tool) or other portions of the oilfield for gathering information about various parameters, such as surface parameters, downhole parameters and/or operating conditions. These sensors preferably measure oilfield parameters, such as weight on bit, torque on bit, pressures, temperatures, flow rates, compositions, measured depth, azimuth, inclination and other parameters of the oilfield operation.

The information gathered by the sensors may be collected by the surface unit and/or other data collection sources for analysis or other processing. The data collected by the sensors may be used alone or in combination with other data. The data may be collected in a database and all or select portions of the data may be selectively used for analyzing and/or predicting oilfield operations of the current and/or other wellbores.

Data outputs from the various sensors positioned about the oilfield may be processed for use. The data may be historical data, real-time data or combinations thereof. The real-time data may be used in real-time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical and/or reservoir engineering simulations. The reservoir, wellbore, surface and/or process data may be used to perform reservoir, wellbore, or other production simulations. The data outputs from the oilfield operation may be generated directly from the sensors, or after some preprocessing or modeling. These data outputs may act as inputs for further analysis.

The data is collected and stored at the surface unit (134). One or more surface units may be located at the oilfield, or linked remotely thereto. The surface unit may be a single unit, or a complex network of units used to perform the necessary data management functions throughout the oilfield. The surface unit may be a manual or automatic system. The surface unit may be operated and/or adjusted by a user.

The surface unit may be provided with a transceiver (137) to allow communications between the surface unit and various portions of the oilfield and/or other locations. The surface unit may also be provided with or functionally linked to a controller for actuating mechanisms at the oilfield. The surface unit may then send command signals to the oilfield in response to data received. The surface unit may receive commands via the transceiver or may itself execute commands to the controller. A processor may be provided to analyze the data (locally or remotely) and make the decisions to actuate the controller. In this manner, the oilfield may be selectively adjusted based on the data collected. These adjustments may be made automatically based on computer protocol, or manually by an operator. In some cases, well plans and/or well placement may be adjusted to select optimum operating conditions, or to avoid problems.

Figure 1C:
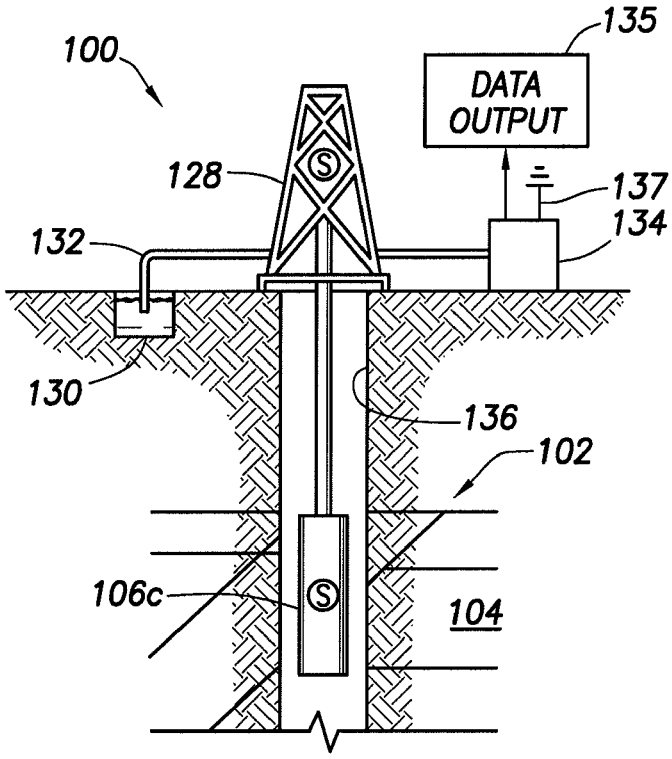
FIG. 1C (Prior Art)

FIG. 1C depicts a wireline operation being performed by a wireline tool (106*c*) suspended by the rig (128) and into the wellbore (136) of FIG. 1B. The wireline tool is preferably adapted for deployment into a wellbore for performing well logs, performing downhole tests and/or collecting samples. The wireline tool may be used to provide another method and apparatus for performing a seismic survey operation. The wireline tool of FIG. 1C may have an explosive or acoustic energy source that provides electrical signals to the surrounding subterranean formations (102).

The wireline tool may be operatively linked to, for example, the geophones (118) stored in the computer (122*a*) of the seismic recording truck (106*a*) of FIG. 1A. The wireline tool may also provide data to the surface unit (134). As shown data output (135) is generated by the wireline tool and collected at the surface. The wireline tool may be positioned at various depths in the wellbore to provide a survey of the subterranean formation.

Figure 1D:
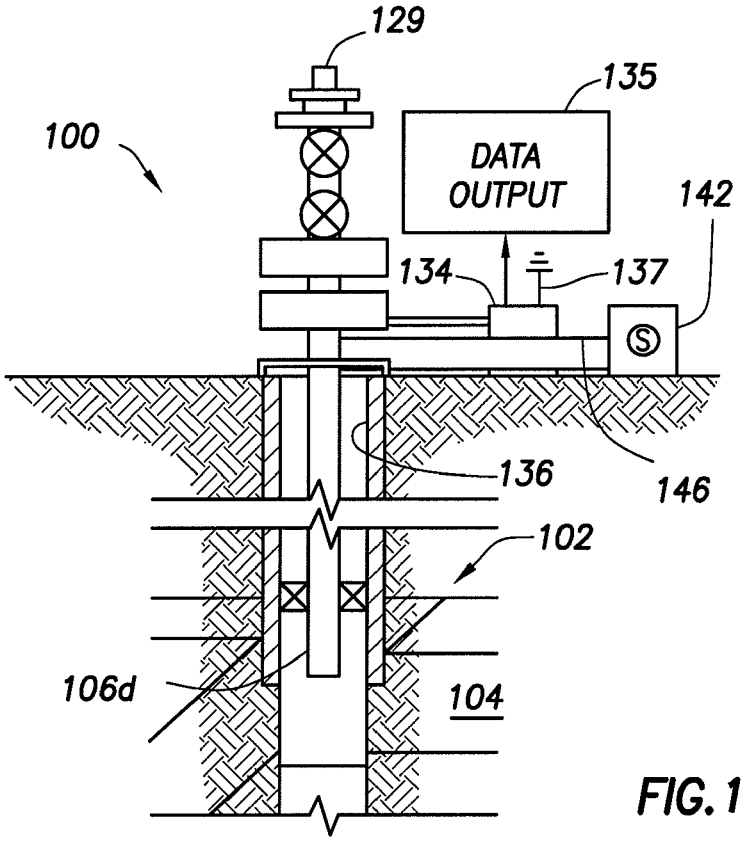
FIG. 1D (Prior Art)

FIG. 1D depicts a production operation being performed by a production tool (106*d*) deployed from a production unit or Christmas tree (129) and into the completed wellbore (136) of FIG. 1C for drawing fluid from the downhole reservoirs into surface facilities (142). Fluid flows from reservoir (104) through perforations in the casing (not shown) and into the production tool (106*d*) in the wellbore (136) and to the surface facilities (142) via a gathering network (146). Sensors (S) positioned about the oilfield are operatively connected to a surface unit (142) for collecting data therefrom. During the production process, data output (135) may be collected from various sensors and passed to the surface unit and/or processing facilities. This data may be, for example, reservoir data, wellbore data, surface data and/or process data. As shown, the sensor (S) may be positioned in the production tool (106*d*) or associated equipment, such as the christmas tree, gathering network, surface facilities and/or the production facility, to measure fluid parameters, such as fluid composition, flow rates, pressures, temperatures, and/or other parameters of the production operation.

While only one wellsite is shown, it will be appreciated that the oilfield may cover a portion of land that hosts one or more wellsites. One or more gathering facilities may be operatively connected to one or more of the wellsites for selectively collecting downhole fluids from the wellsite(s).

Throughout the oilfield operations depicted in FIGS. 1A-D, there are numerous business considerations. For example, the equipment used in each of these figures has various costs and/or risks associated therewith. At least some of the data collected at the oilfield relates to business considerations, such as value and risk. This business data may include, for example, production costs, rig time, storage fees, price of oil/gas, weather considerations, political stability, tax rates, equipment availability, geological environment and other factors that affect the cost of performing the oilfield operations or potential liabilities relating thereto. Decisions may be made and strategic business plans developed to alleviate potential costs and risks. For example, an oilfield plan may be based on these business considerations. Such an oilfield plan may, for example, determine the location of the rig, as well as the depth, number of wells, duration of operation and other factors that will affect the costs and risks associated with the oilfield operation.

While FIGS. 1A-1D depict monitoring tools used to measure properties of an oilfield, it will be appreciated that the tools may be used in connection with non-oilfield operations, such as mines, aquifers or other subterranean facilities. Also, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors S may be located at various positions along the subterranean formation and/or the monitoring tools to collect and/or monitor the desired data. Other sources of data may also be provided from offsite locations.

The oilfield configuration of FIG. 1 is not intended to limit the scope of the invention. Part, or all, of the oilfield may be on land and/or sea. Also, while a single oilfield measured at a single location is depicted, the present invention may be utilized with any combination of one or more oilfields, one or more processing facilities and one or more wellsites.

Figure 2A:
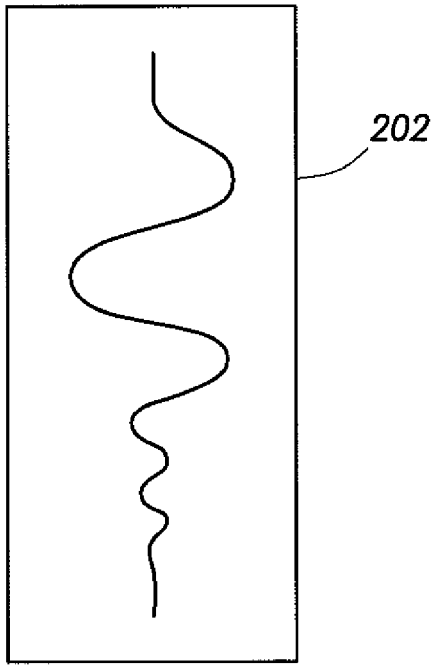
FIGS. 2A-2D show graphical depictions of data collected by the tools of FIGS. 1A-D, respectively.
Figure 2B:
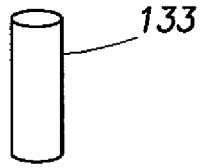
Figure 2C:
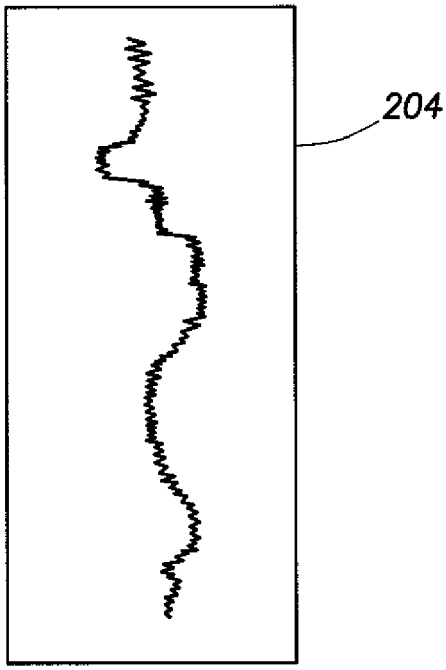
Figure 2D:
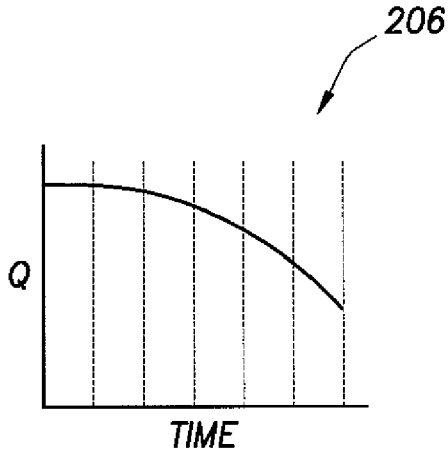

FIGS. 2A-D are graphical depictions of data collected by the tools of FIGS. 1A-D, respectively. FIG. 2A depicts a seismic trace (202) of the subterranean formation of FIG. 1A taken by survey tool (106*a*). The seismic trace measures the two-way response over a period of time. FIG. 2B depicts a core sample (133) taken by the logging tool (106*b*). The core test typically provides a graph of the density, resistivity or other physical property of the core sample over the length of the core. FIG. 2C depicts a well log (204) of the subterranean formation of FIG. 1C taken by the wireline tool (106*c*). The wireline log typically provides a resistivity measurement of the formation at various depts. FIG. 2D depicts a production decline curve (206) of fluid flowing through the subterranean formation of FIG. 1D taken by the production tool (106*d*). The production decline curve typically provides the production rate (Q) as a function of time (t).

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

The models may be used to create an earth model defining the subsurface conditions. This earth model predicts the structure and its behavior as oilfield operations occur. As new information is gathered, part or all of the earth model may need adjustment.

Figure 3:
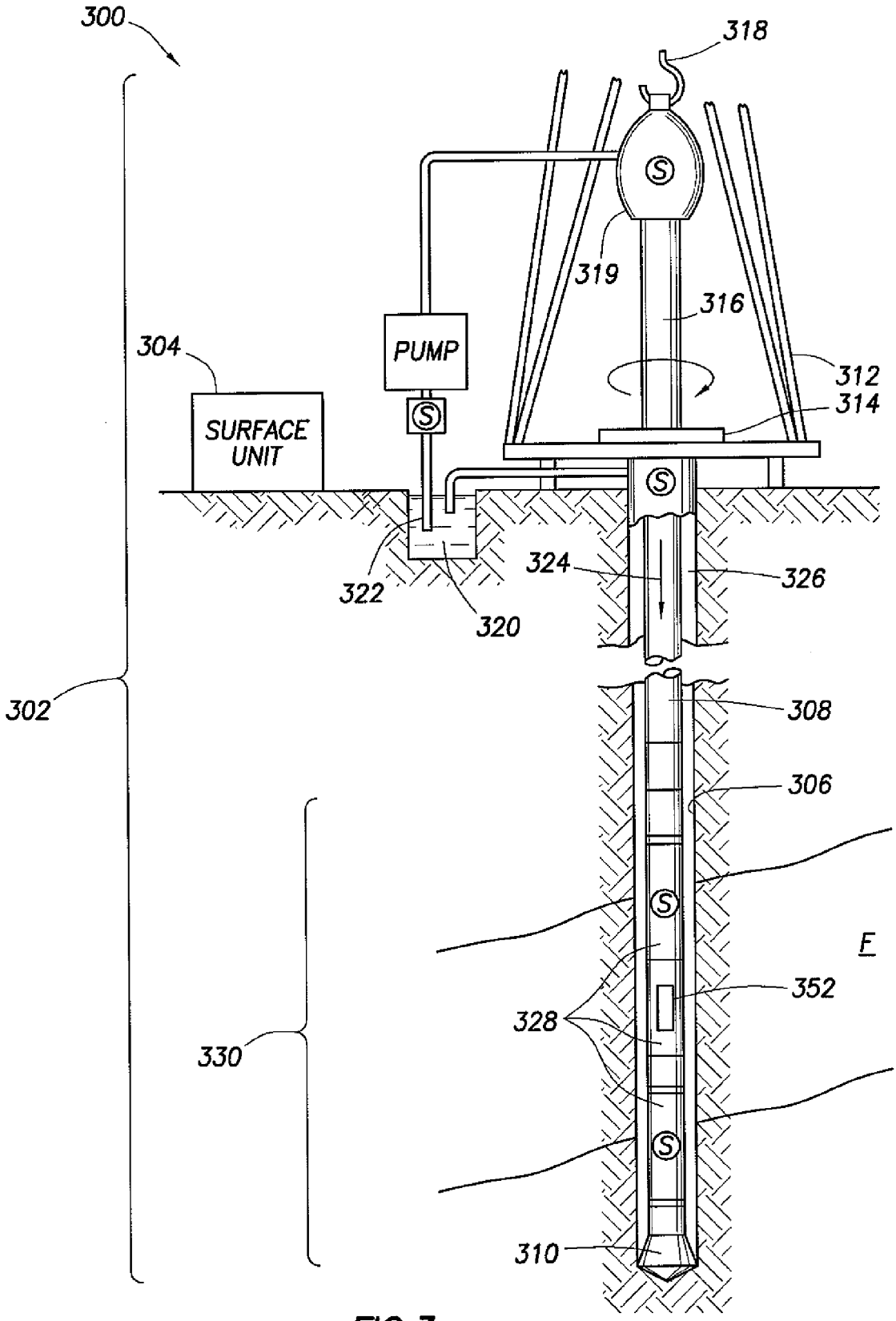
FIG. 3 show a schematic view, partially in cross-section of a drilling operation of an oilfield.

FIG. 3 is a schematic view of a wellsite (300) depicting a drilling operation, such as the drilling operation of FIG. 1B, of an oilfield in detail. The wellsite system (300) includes a drilling system (302) and a surface unit (304). In the illustrated embodiment, a borehole (306) is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

The drilling system (302) includes a drill string (308) suspended within the borehole (306) with a drill bit (310) at its lower end. The drilling system (302) also includes the land-based platform and derrick assembly (312) positioned over the borehole (306) penetrating a subsurface formation (F). The assembly (312) includes a rotary table (314), kelly (316), hook (318) and rotary swivel (319). The drill string (308) is rotated by the rotary table (314), energized by means not shown, which engages the kelly (316) at the upper end of the drill string. The drill string (308) is suspended from hook (318), attached to a traveling block (also not shown), through the kelly (316) and a rotary swivel (319) which permits rotation of the drill string relative to the hook.

The drilling system (302) further includes drilling fluid or mud (320) stored in a pit (322) formed at the well site. A pump (324) delivers the drilling fluid (320) to the interior of the drill string (308) via a port in the swivel (319), inducing the drilling fluid to flow downwardly through the drill string (308) as indicated by the directional arrow (324). The drilling fluid exits the drill string (308) via ports in the drill bit (310), and then circulates upwardly through the region between the outside of the drill string and the wall of the borehole, called the annulus (326). In this manner, the drilling fluid lubricates the drill bit (310) and carries formation cuttings up to the surface as it is returned to the pit (322) for recirculation.

The drill string (308) further includes a bottom hole assembly (BHA), generally referred to as (330), near the drill bit (310) (in other words, within several drill collar lengths from the drill bit). The bottom hole assembly (330) includes capabilities for measuring, processing, and storing information, as well as communicating with the surface unit. The BHA (330) further includes drill collars (328) for performing various other measurement functions.

Sensors (S) are located about the wellsite to collect data, preferably in real-time, concerning the operation of the wellsite, as well as conditions at the wellsite. The sensors (S) of FIG. 3 may be the same as the sensors of FIGS. 1A-D. The sensors of FIG. 3 may also have features or capabilities, of monitors, such as cameras (not shown), to provide pictures of the operation. Surface sensors or gauges S may be deployed about the surface systems to provide information about the surface unit, such as standpipe pressure, hookload, depth, surface torque, rotary rpm, among others. Downhole sensors or gauges (S) are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the various parts of the drilling system and/or the surface control unit.

The drilling system (302) is operatively connected to the surface unit (304) for communication therewith. The BHA (330) is provided with a communication subassembly (352) that communicates with the surface unit. The communication subassembly (352) is adapted to send signals to and receive signals from the surface using mud pulse telemetry. The communication subassembly may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

Figure 4:
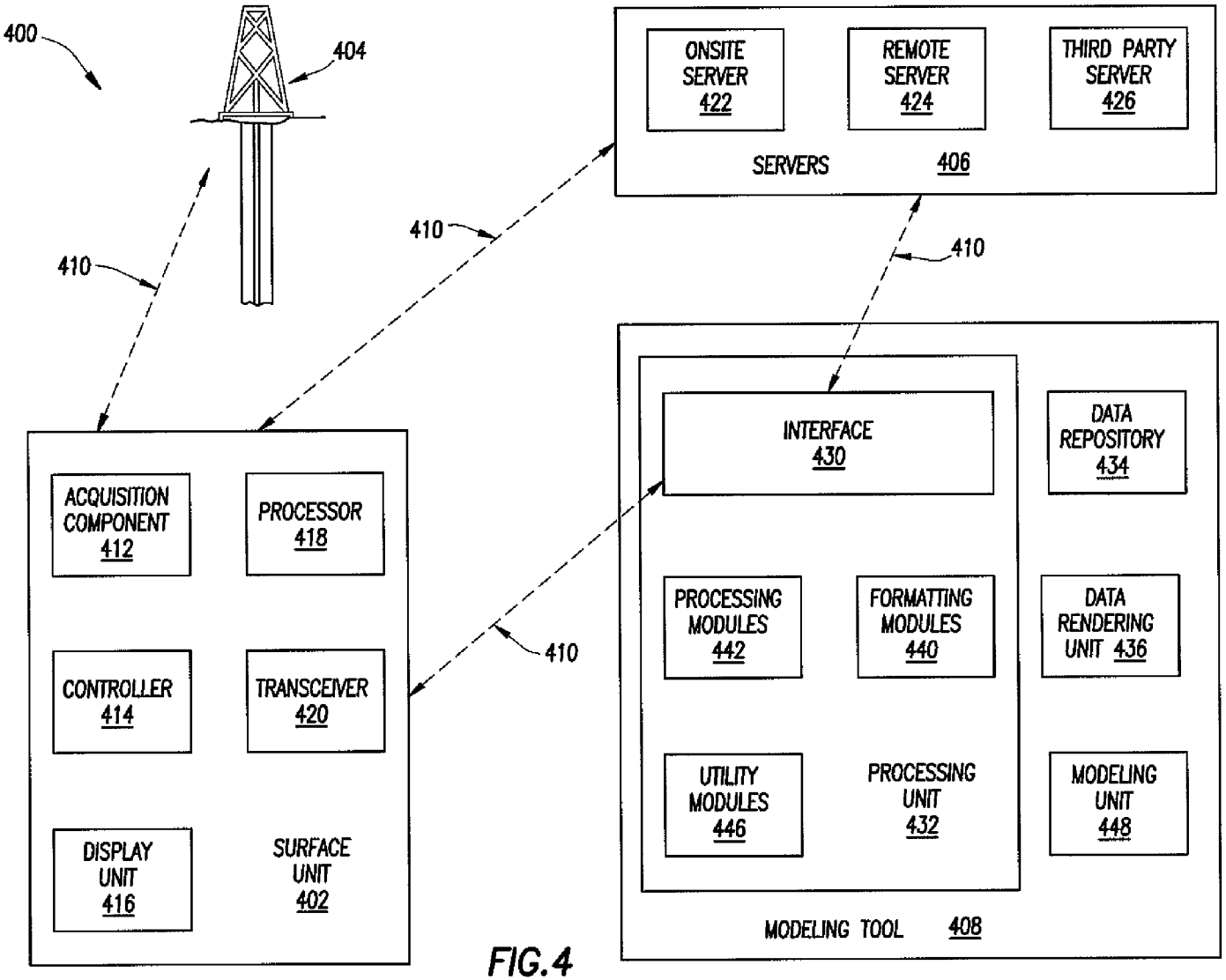
FIG. 4 show a schematic diagram of a system for performing a drilling operation of an oilfield.

FIG. 4 is a schematic view of a system (400) for performing a drilling operation of an oilfield. As shown, the system (400) includes a surface unit (402) operatively connected to a wellsite drilling system (404), servers (406) operatively linked to the surface unit (402), and a modeling tool (408) operatively linked to the servers (406). As shown, communication links (410) are provided between the wellsite drilling system (404), surface unit (402), servers (406), and modeling tool (408). A variety of links may be provided to facilitate the flow of data through the system. For example, the communication links (410) may provide for continuous, intermittent, one-way, two-way and/or selective communication throughout the system (400). The communication links (410) may be of any type, such as wired, wireless, etc.

The wellsite drilling system (404) and surface unit (402) may be the same as the wellsite drilling system and surface unit of FIG. 3. The surface unit (402) is preferably provided with an acquisition component (412), a controller (414), a display unit (416), a processor (418) and a transceiver (420). The acquisition component (412) collects and/or stores data of the oilfield. This data may be data measured by the sensors (S) of the wellsite as described with respect to FIG. 3. This data may also be data received from other sources.

The controller (414) is enabled to enact commands at the oilfield. The controller (414) may be provided with actuation means that can perform drilling operations, such as steering, advancing, or otherwise taking action at the wellsite. Commands may be generated based on logic of the processor (418), or by commands received from other sources. The processor (418) is preferably provided with features for manipulating and analyzing the data. The processor (418) may be provided with additional functionality to perform oilfield operations.

A display unit (416) may be provided at the wellsite and/or remote locations for viewing oilfield data (not shown). The oilfield data represented by a display unit (416) may be raw data, processed data and/or data outputs generated from various data. The display unit (416) is preferably adapted to provide flexible views of the data, so that the screens depicted may be customized as desired. A user may determine the desired course of action during drilling based on reviewing the displayed oilfield data. The drilling operation may be selectively adjusted in response to the display unit (416). The display unit (416) may include a two dimensional display for viewing oilfield data or defining oilfield events. The display unit (416) may also include a three dimensional display for viewing various aspects of the drilling operation. At least some aspect of the drilling operation is preferably viewed in real-time in the three dimensional display.

The transceiver (420) provides a means for providing data access to and/or from other sources. The transceiver also provides a means for communicating with other components, such as the servers (406), the wellsite drilling system (404), surface unit (402) and/or the modeling tool (408).

The servers (406) may be used to transfer data from one or more wellsites to the modeling tool (408). As shown, the server (406) includes onsite servers (422), a remote server (424) and a third party server (426). The onsite servers (422) may be positioned at the wellsite and/or other locations for distributing data from the surface unit. The remote server (424) is positioned at a location away from the oilfield and provides data from remote sources. The third party server (426) may be onsite or remote, but is operated by a third party, such as a client.

The servers (406) are preferably capable of transferring drilling data, such as logs, drilling events, trajectory, and/or other oilfield data, such as seismic data, historical data, economics data, or other data that may be of use during analysis. The type of server is not intended to limit the invention. Preferably the system is adapted to function with any type of server that may be employed.

The servers (406) communicate with the modeling tool (408) as indicated by the communication links (410). As indicated by the multiple arrows, the servers (406) may have separate communication links (410) with the modeling tool (408). One or more of the servers may be combined or linked to provide a combined communication link (410).

The servers (406) collect a wide variety of data. The data may be collected from a variety of channels that provide a certain type of data, such as well logs. The data from the servers is passed to the modeling tool (408) for processing. The servers (406) may also be used to store and/or transfer data.

The modeling tool (408) is operatively linked to the surface unit (402) for receiving data therefrom. In some cases, the modeling tool (408) and/or server(s) (406) may be positioned at the wellsite. The modeling tool (408) and/or server(s) (406) may also be positioned at various locations. The modeling tool (408) may be operatively linked to the surface unit via the server(s) (406). The modeling tool (408) may also be included in or located near the surface unit (402).

The modeling tool (408) includes an interface (430), a processing unit (432), a modeling unit (448), a data repository (434) and a data rendering unit (436). The interface (430) communicates with other components, such as the servers (406). The interface (430) may also permit communication with other oilfield or non-oilfield sources. The interface (430) receives the data and maps the data for processing. Data from servers (406) typically streams along predefined channels which may be selected by the interface (430).

As depicted in FIG. 4, the interface (430) selects the data channel of the server(s) (406) and receives the data. The interface (430) also maps the data channels to data from the wellsite. The data may then be passed to the processing modules (442) of the modeling tool (408). Preferably, the data is immediately incorporated into the modeling tool (408) for real-time sessions or modeling. The interface (430) creates data requests (for example surveys, logs and risks), displays the user interface, and handles connection state events. The interface (430) also instantiates the data into a data object for processing.

The processing unit (432) includes formatting modules (440), processing modules (442), coordinating modules (444), and utility modules (446). These modules are designed to manipulate the oilfield data for real-time analysis.

The formatting modules (440) are used to conform the data to a desired format for processing. Incoming data may need to be formatted, translated, converted or otherwise manipulated for use. The formatting modules (440) are configured to enable the data from a variety of sources to be formatted and used so that the data processes and displays in real-time.

As shown, the formatting modules (440) include components for formatting the data, such as a unit converter and the mapping components. The unit converter converts individual data points received from the interface into the format expected for processing. The format may be defined for specific units, provide a conversion factor for converting to the desired units, or allow the units and/or conversion factor to be defined. To facilitate processing, the conversions may be suppressed for desired units.

The mapping component maps data according to a given type or classification, such as a certain unit, log mnemonics, precision, max/min of color table settings, etc. The type for a given set of data may be assigned, particularly when the type is unknown. The assigned type and corresponding map for the data may be stored in a file (ie. XML) and recalled for future unknown data types.

The coordinating modules (444) orchestrate the data flow throughout the modeling tool. The data is manipulated so that it flows according to a choreographed plan. The data may be queued and synchronized so that it processes according to a timer and/or a given queue size. The coordinating modules include the queuing components, the synchronization components, the management component, the modeling tool mediator component, the settings component and the real-time handling component.

The queuing module groups the data in a queue for processing through the system. The system of queues provides a certain amount of data at a given time so that it may be processed in real-time.

The synchronization component links certain data together so that collections of different kinds of data may be stored and visualized in the modeling tool concurrently. In this manner, certain disparate or similar pieces of data may be choreographed so that they link with other data as it flows through the system. The synchronization component provides the ability to selectively synchronize certain data for processing. For example, log data may be synchronized with trajectory data. Where log samples have a depth that extends beyond the wellbore, the samples may be displayed on the canvas using a tangential projection so that, when the actual trajectory data is available, the log samples will be repositioned along the wellbore. Alternatively, incoming log samples that aren't on the trajectory may be cached so that, when the trajectory data is available, the data samples may be displayed. In cases where the log sample cache fills up before the trajectory data is received, the samples may be committed and displayed.

The settings component defines the settings for the interface. The settings component may be set to a desired format, and adjusted as necessary. The format may be saved, for example, in an XML file for future use.

The real-time handling component instantiates and displays the interface and handles its events. The real-time handling component also creates the appropriate requests for channel or channel types, handles the saving and restoring of the interface state when a set of data or its outputs is saved or loaded.

The management component implements the required interfaces to allow the module to be initialized by and integrated for processing.

The mediator component receives the data from the interface. The mediator caches the data and combines the data with other data as necessary. For example, incoming data relating to trajectories, risks, and logs may be added to wellbores stored in the modeling tool. The mediator may also merge data, such as survey and log data.

The utility modules (446) provide support functions to the drilling system. The utility modules (446) include the logging component (not shown) and the user interface (UI) manager component (not shown). The logging component provides a common call for all logging data. This module allows the logging destination to be set by the application. The logging module may also be provided with other features, such as a debugger, a messenger, and a warning system, among others. The debugger sends a debug message to those using the system. The messenger sends information to subsystems, users, and others. The information may or may not interrupt the operation and may be distributed to various locations and/or users throughout the system. The warning system may be used to send error messages and warnings to various locations and/or users throughout the system. In some cases, the warning messages may interrupt the process and display alerts.

The UI manager component creates user interface elements for displays. The UI manager component defines user input screens, such as menu items, context menus, toolbars, and settings windows. The user manager may also be used to handle events relating to these user input screens.

The processing module (442) is used to analyze the data and generate outputs. As described above, the data may include static data, dynamic data, historic data, real-time data, or other types of data. Further, the data may relate to various aspects of the oilfield operations, such as formation structure, geological stratigraphy, core sampling, well logging, density, resistivity, fluid composition, flow rate, downhole condition, surface condition, equipment condition, or other aspects of the oilfield operations.

The processing module (442) may be used to analyze these data for generating earth model and making decisions at various locations of the oilfield at various times. For example, an oilfield event, such as drilling event, risk, lesson learned, best practice, or other types of oilfield events may be defined from analyzing these data. Examples of drilling event include stuck pipe, loss of circulation, shocks observed, or other types of drilling events encountered in real-time during drilling at various depths and lasting for various durations. Examples of risk includes potential directional control issue from formation dips, potential shallow water flow issue, or other types of potential risk issues. For example, the risk issues may be predicted from analyzing the earth model based on historic data compiled prior to drilling or real-time data acquired during drilling. Lessons learned and best practice may be developed from neighboring wellbores with similar conditions or equipments and defined as oilfield events for reference in determining the desired course of action during drilling.

An oilfield event may be generated in various different formats (e.g., Wellsite Information Transfer Standard Markup Language (WITSML), or the like) by the processing module (442). Each oilfield event may include attributes such as start depth, end depth, type, category, severity, probability, description, mitigation, affected personal, or other types of attributes. These attribute may be represented in one or more data fields of the various different formats, such as the WITSML or the like.

An exemplary oilfield event may be defined in the WITSML format with the following data fields:

```
<type>Risk</type>
<category>DirectionalDrilling</category>
<mdHoleStart uom="m">2391.13</mdHoleStart>
<mdHoleEnd uom="m">2433.52</mdHoleEnd>
<tvdHoleStart uom="m">2221.21304784503</tvdHoleStart>
<tvdHoleEnd uom="m">2239.18532207365</tvdHoleEnd>
<mdBitStart uom="m">2391.13</mdBitStart>
<mdBitEnd uom="m">2391.13</mdBitEnd>
<severityLevel>2</severityLevel>
<probabilityLevel>2</probabilityLevel>
<summary>Directional Control difficulty due to dipping
formations</summary>
<details>Formation dips of about 20 degrees to the top of the M9 sand,
and 25 degrees in the M9 are expected. These dips could present
a directional control issue.</details>
```

In a drilling operation in an oilfield, usually a large number of such oilfield events exist that occur along the wellbore trajectory. The oilfield events often overlap each other at over the expanse of certain depths (i.e., start depth and end depth) along the trajectory. The processing module (442) generates these oilfield events which can be shown with positions relative to the wellbore trajectory and event attributes (e.g., severity and probability) annotated for making decisions at various locations of the oilfield at various times. The expanse of certain depths of the oilfield event can also be shown for comparing the event with geological features surrounding the wellbore trajectory.

As noted above, the processing module (442) is used to analyze the data and generate outputs. The processing component includes the trajectory management component.

The trajectory management component handles the case when the incoming trajectory information indicates a special situation or requires special handling (such as the data pertains to depths that are not strictly increasing or the data indicates that a sidetrack borehole path is being created). For example, when a sample is received with a measured depth shallower than the hole depth, the trajectory module determines how to process the data. The trajectory module may ignore all incoming survey points until the MD exceeds the previous MD on the wellbore path, merge all incoming survey points below a specified depth with the existing samples on the trajectory, ignore points above a given depth, delete the existing trajectory data and replace it with a new survey that starts with the incoming survey station, create a new well and set its trajectory to the incoming data, and add incoming data to this new well, and prompt the user for each invalid point. All of these options may be exercised in combinations and can be automated or set manually.

The data repository (434) may store the data for the modeling unit. The data is preferably stored in a format available for use in real-time (e.g., information is updated at approximately the same rate the information is received). The data is generally passed to the data repository from the processing component. The data can be persisted in the file system (e.g., as an extensible markup language (XML) file) or in a database. The system determines which storage is the most appropriate to use for a given piece of data and stores the data in a manner to enable automatic flow of the data through the rest of the system in a seamless and integrated fashion. The system also facilitates manual and automated workflows (such as Modeling, Geological & Geophysical workflows) based upon the persisted data.

The data rendering unit (436) performs rendering algorithm calculation to provide one or more displays for visualizing the data. The displays may be presented to a user at the display unit (416). The data rendering unit (436) may contain a 2D canvas, a 3D canvas, a well section canvas or other canvases as desired.

The data rendering unit (436) may selectively provide displays composed of any combination of one or more canvases. The canvases may or may not be synchronized with each other during display. The data rendering unit (436) is preferably provided with mechanisms for actuating various canvases or other functions in the system. Further, the data rendering unit (436) may be configured to provide displays representing the oilfield events generated from the real-time drilling data acquired in real-time during drilling, the oilfield events generated from historic data of neighboring wellbores compiled over time, the current trajectory of the wellbore during drilling, the earth model generated from static data of subterranean geological features, and/or any combinations thereof. In addition, the data rendering unit (436) may be configured to selectively adjust the displays based on real-time drilling data as the drilling tool of the drilling system (404) advances into a subterranean formation.

Each oilfield event occupies certain space on a canvas as it is represented in the display. To simultaneously display a large number of oilfield events in an intuitive manner (i.e., without cluttering the canvas and the display, obscuring the image of the wellbore trajectory and the earth model, or other arrangements that may degrade the clarity of the display), from time to time a user may select or re-select a portion of the large number of oilfield events for display. The data rendering unit (436) is further configured to perform re-calculation of the rendering algorithms in real-time for optimizing the clarity of the display as the selected portion of the oilfield events is supplemented, selectively adjusted, or otherwise changed. For example, the rendering algorithm may re-use un-occupied space made available after one or more oilfield events are removed from the selected portion of the oilfield events for display. More details of the rendering algorithm are described in reference to FIGS. 6-8, which are shown and described below.

Modeling unit (448) performs the key modeling functions for generating complex oilfield outputs. The modeling unit (448) may be a conventional modeling tool capable of performing modeling functions, such as generating, analyzing and manipulating earth models. The earth models typically contain exploration and production data, such as that shown in FIG. 2A-2D.

While specific components are depicted and/or described for use in the units and/or modules of the modeling tool (408), it will be appreciated that a variety of components with various functions may be used to provide the formatting, processing, utility and coordination functions necessary to provide real-time processing in the modeling tool (408). The components may have combined functionalities and may be implemented as software, hardware, firmware, or combinations thereof.

Further, components (e.g., the processing modules (442) and the data rendering unit (436)) of the modeling tool (408) may be located in a onsite server (422) or in distributed locations where remote server (424) and/or third party server (426) may be involved. The onsite server (422) may be located within the surface unit (402).

Figure 5:
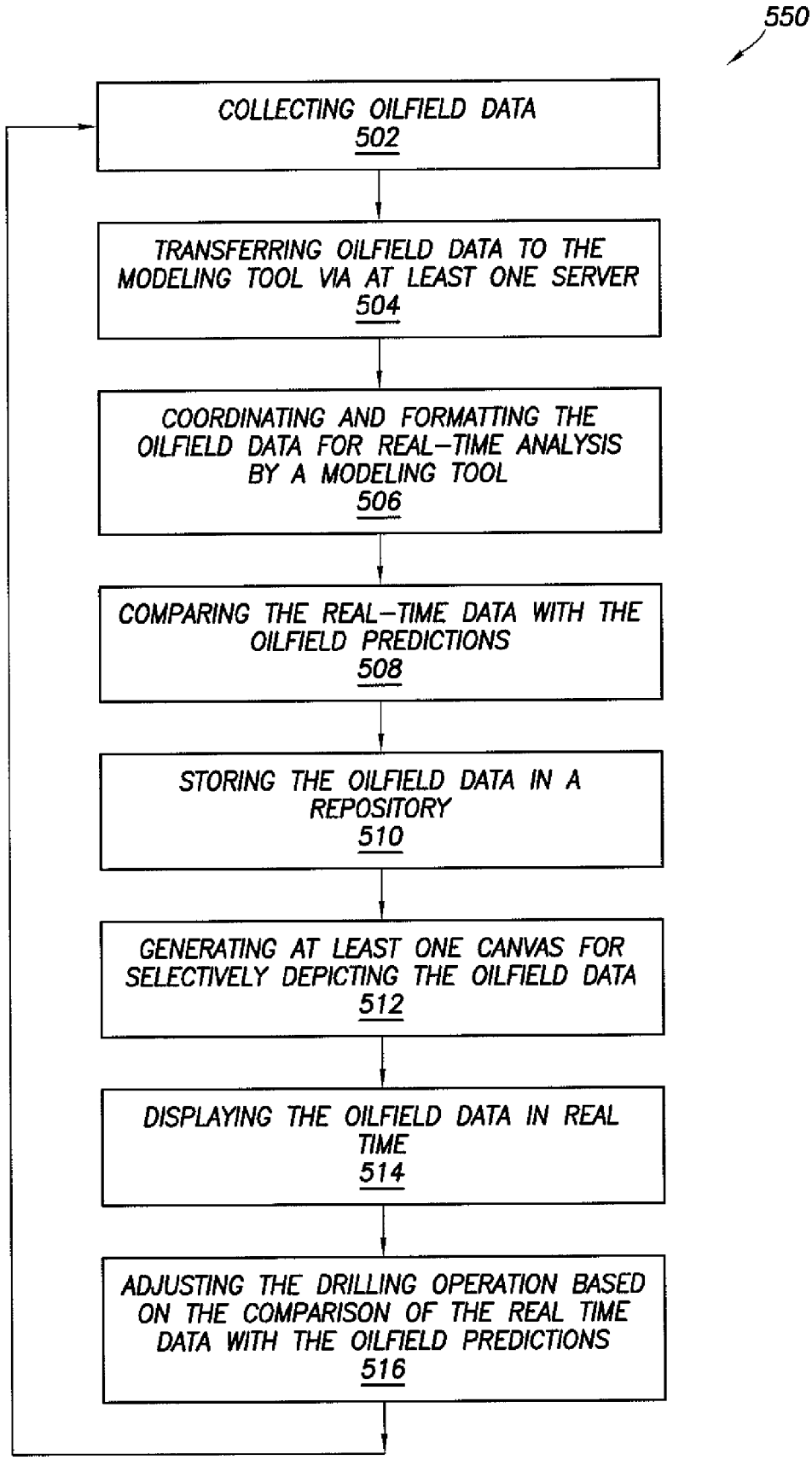
FIG. 5 shows a flow chart depicting a method of performing a drilling operation of an oilfield.

FIG. 5 depicts a method (550) for performing a drilling operation of an oilfield. The method may be performed using, for example, the system of FIG. 4. The method involves collecting data (502), coordinating and formatting the oilfield data for real-time processing by a modeling tool (506), comparing the drilling data with the oilfield predictions (508), and displaying the oilfield data in real-time (514). The method may also optionally involve transferring oilfield data to the modeling tool via at least one server (504), storing the oilfield data in a repository (510), generating at least one canvas for selectively depicting the oilfield data (512), and adjusting the drilling operation based on the comparison of the drilling data and the oilfield predictions (518).

The oilfield data may be collected (502) from a variety of sources. As discussed with respect to FIGS. 3 and 4, data may be generated by sensors at the wellsite or from other sources. The data is transferred to the modeling tool. The data may be transferred directly to the modeling tool, or transferred to the modeling tool via at least one server (504). The data is then received by the interface of the modeling tool.

The oilfield data is formatted for real-time processing by a modeling tool (506). The formatting components of the modeling tool may be used to selectively queue the data and stream it through the system. The data is selectively grouped and timed to facilitate data flow in real-time. The data is also translated, synchronized, converted or otherwise formatted so that it may be efficiently processed by the modeling tool.

Once formatted for real-time processing, a new drilling plan may be generated in real-time by selectively analyzing the oilfield data. The formatted data is processed by the processing components of the modeling tool. Preferably, certain types of data are processed so that the drilling plan and other data may be generated in real-time. The drilling data may then be compared with oilfield predictions 508, such as a predefined earth model and/or drilling plan. The data may be stored in the data repository (510).

The oilfield data (processed and/or processed) may be used to generate canvasses for selectively depicting the oilfield data (512). The oilfield data is collected and queued so that it may be displayed in real-time and according to various formats for viewing by a user. The various canvases define layouts for visualization of the data. Data may be displayed in 2D or 3D as it is collected. As the data is processed and various outputs, such as a drilling plan is generated, the processed data may also be displayed.

The processed data may be further analyzed. In one example, the real-time drilling plan may be compared with a predefined earth model. The predefined earth model is typically a plan that is created before the well is drilled for planning oilfield operations, such as the drilling operation. The drilling plan and the earth model may be adjusted based on the drilling data collected. The real-time drilling data may suggest alternative action is necessary to meet the requirements of the oilfield predictions. If so, a decision may be made to adjust the drilling operation based on the real-time data (516).

Figure 6A:
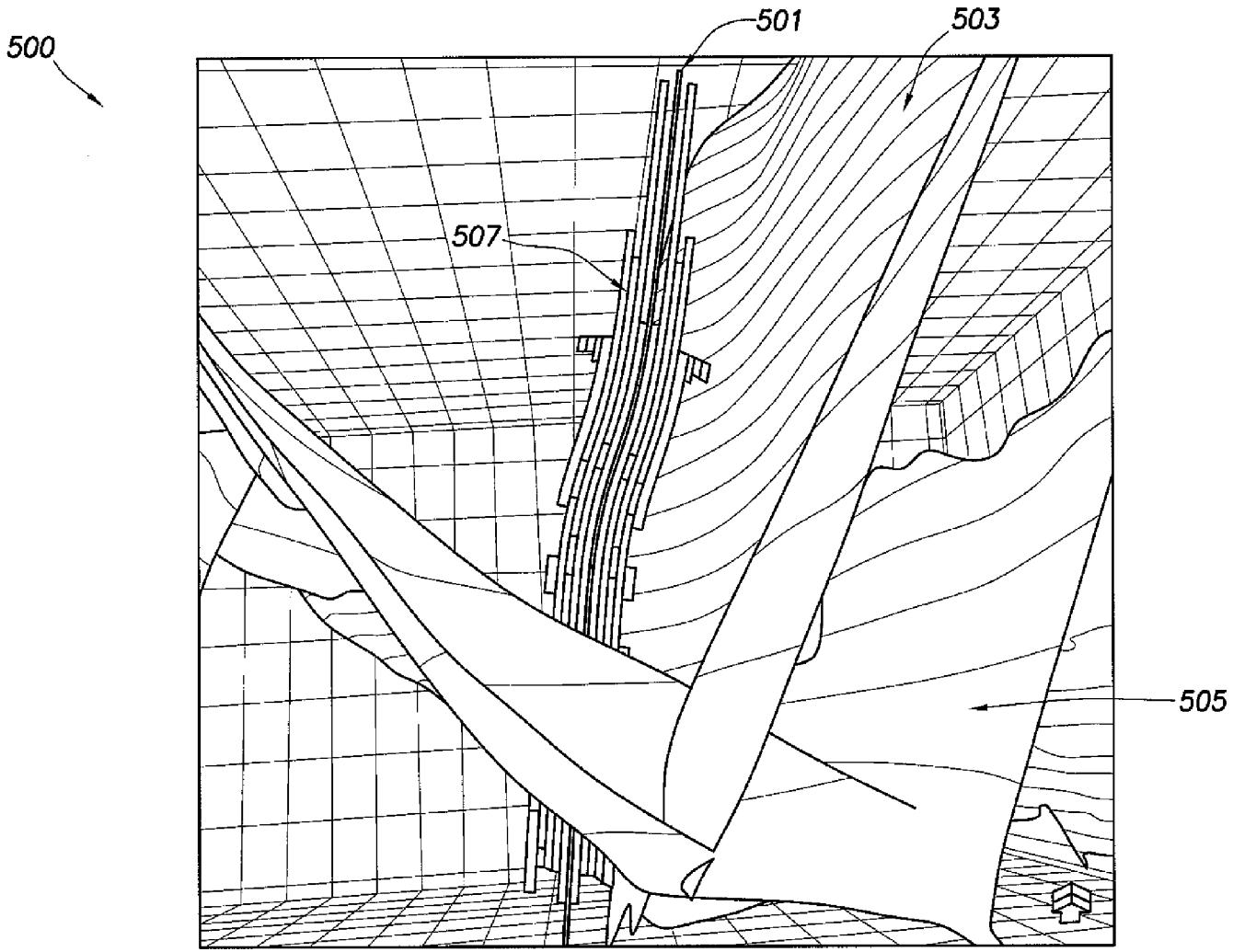
FIG. 6A shows a screen shot of a exemplary three dimensional (3D) display representing multiple oilfield events.

FIG. 6A shows a screen shot of a exemplary 3D display representing multiple oilfield events. The 3D display (500) includes the wellbore image (501), the subterranean formation image A (503), the subterranean formation image B (505), and icons (i.e., graphical depictions such as colored strip, colored ribbon, colored diamond, or the like) representing the oilfield events (507). The term "icon" is used interchangeably with the term "graphical depiction" throughout this document. The 3D display (500) may be a static display representing historic data of a prior drilling operation or a dynamic display representing a drilling operation in progress.

In the case of the dynamic display, the wellbore image (501) and the icons representing the oilfield events (507) may be updated in real-time as the drilling tool advances into the subterranean formation represented by the subterranean formation image A (503) and image B (505). The 3D display (500) may be provided by the data rendering unit (436) and presented at the display unit (416) as described in reference to FIG. 4 above.

As depicted in FIG. 6A, the icons representing the oilfield events (507) are configured as a billboard-like object positioned about the wellbore image (501) in the 3D display (500). As an example, a portion of the wellbore image and the icons representing the oilfield events are obscured by the subterranean formation images. The data rendering unit (436) may be provided with a mechanism to adjust the viewing angle of the 3D display such that the obscured portion of the wellbore image and the icons representing the oilfield events may be revealed. Further, the data rendering unit (436) may be provided with a mechanism to orient the icons representing the oilfield events in the 3D display according to the adjusted viewing angle. For example, the icons representing the oilfield events may be oriented by rotating the billboard like object using the wellbore image as an axis of rotation. More details of the icons representing the oilfield events (507) is shown in FIG. 6B.

Figure 6B:
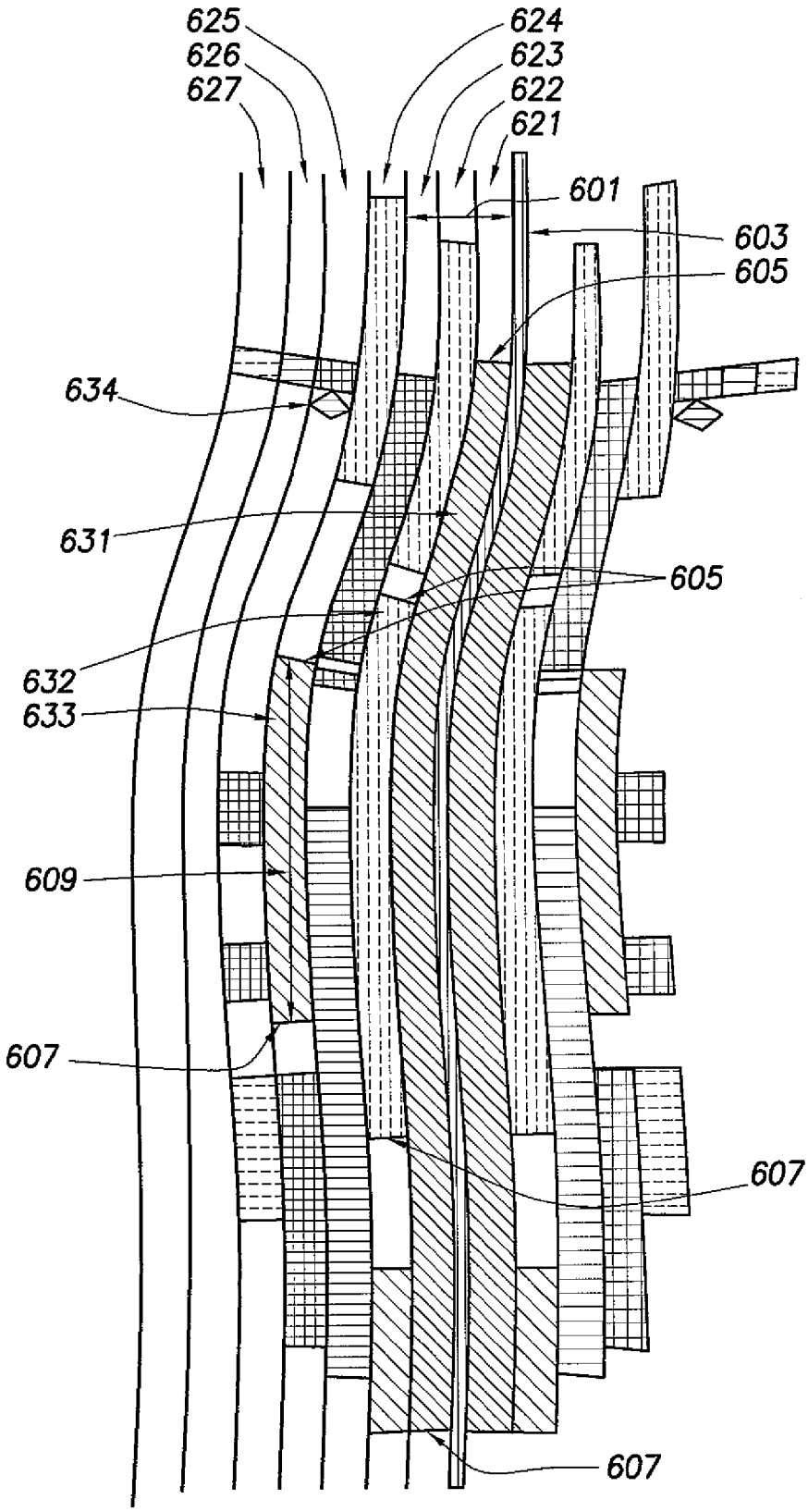
FIG. 6B shows an exemplary representation of multiple oilfield events in the 3D display.

FIG. 6B shows an exemplary representation of multiple oilfield events arranged on a surface of the billboard as shown in FIG. 5. Here, track A through track G (621-627) are spaces allocated as containers for holding oilfield event icons such as the oilfield event icon A through oilfield event icon D (631-634). Each of track A through track G runs parallel to and is located away from the wellbore image (603) by a track offset. For example, oilfield event icon A through oilfield event icon D are placed in track A (621), track B (622), and track D (624), respectively. Track D (624) is located away from the wellbore image (603) by the track offset (601).

The start depths of the oilfield events corresponding to oilfield event icon A through oilfield event icon C are indicated by the multiple arrows originating from the start depth (605). The end depths of the oilfield events corresponding to oilfield event icon A through oilfield event icon C are indicated by the multiple arrows originating from the end depth (607).

Each of oilfield event icon A through oilfield event icon C is shaped like a ribbon in this example with the length of the ribbon representing the expanse of a certain depth of the corresponding oilfield event. The start measured depth and end measured depth of the oilfield event corresponding to the oilfield event icon D (634) are the same as indicated by a diamond shaped icon. While shown in FIG. 6B, the dividing lines may be optionally displayed between tracks (e.g., track A through track G) or disabled between tracks (e.g., unlabeled tracks to the right of the wellbore image (603)). The icons representing oilfield events placed on the left side and the right side of the wellbore image on the billboard-like object are substantially symmetrical and may be envisioned as a cross section of multiple concentric cylinders centered around the wellbore trajectory.

As described in reference to FIG. 4 above, the data rendering unit (436) performs a rendering algorithm calculation to provide one or more displays for visualizing the data. For example, the rendering algorithm calculation may arrange the placement of the oilfield event icons in the following manner to optimize the clarity of the display.

First, the oilfield events selected for display may be ranked according to a ranking algorithm based on one or more of attributes of the oilfield events. For example, the ranking may be according to the expanse of a certain depth where the oilfield event with a longer depth extend is placed ahead of the other oilfield event with a shorter expanse of a certain depth in a sorted list. In other examples, the oilfield events may be ranked according to other weighted combination of one or more selected attributes. Next an ordered collection of tracks are created with each extending, for example, from the top to the bottom along the wellbore image in the 3D display. Each of these ordered collection of tracks is positioned at increasing offsets from the wellbore image. Then, oilfield event icons are placed into these ordered collection of tracks sequentially according to the ranking of the corresponding oilfield events in the sorted list. In the example of the ranking based on the expanse of a certain depth, the oilfield icon corresponding to the longest expanse of a certain depth is placed first in the track closest to the wellbore image. Other oilfield event icons are placed subsequently into closest available tracks to the wellbore image without overlapping already placed oilfield event icons.

Further to the placement of the oilfield event icons, the color, pattern, or other characteristics of the icon may be configured to represents the attributes of the corresponding oilfield event. As described in reference to FIG. 4 above, each oilfield event may include attributes such as start depth, end depth, type, category, severity, probability, description, mitigation, affected personal, or other types of attributes. These attributes may be represented in the display by the location, length, color, pattern, or other characteristics of the oilfield icons as shown in FIG. 6B.

Figure 7:
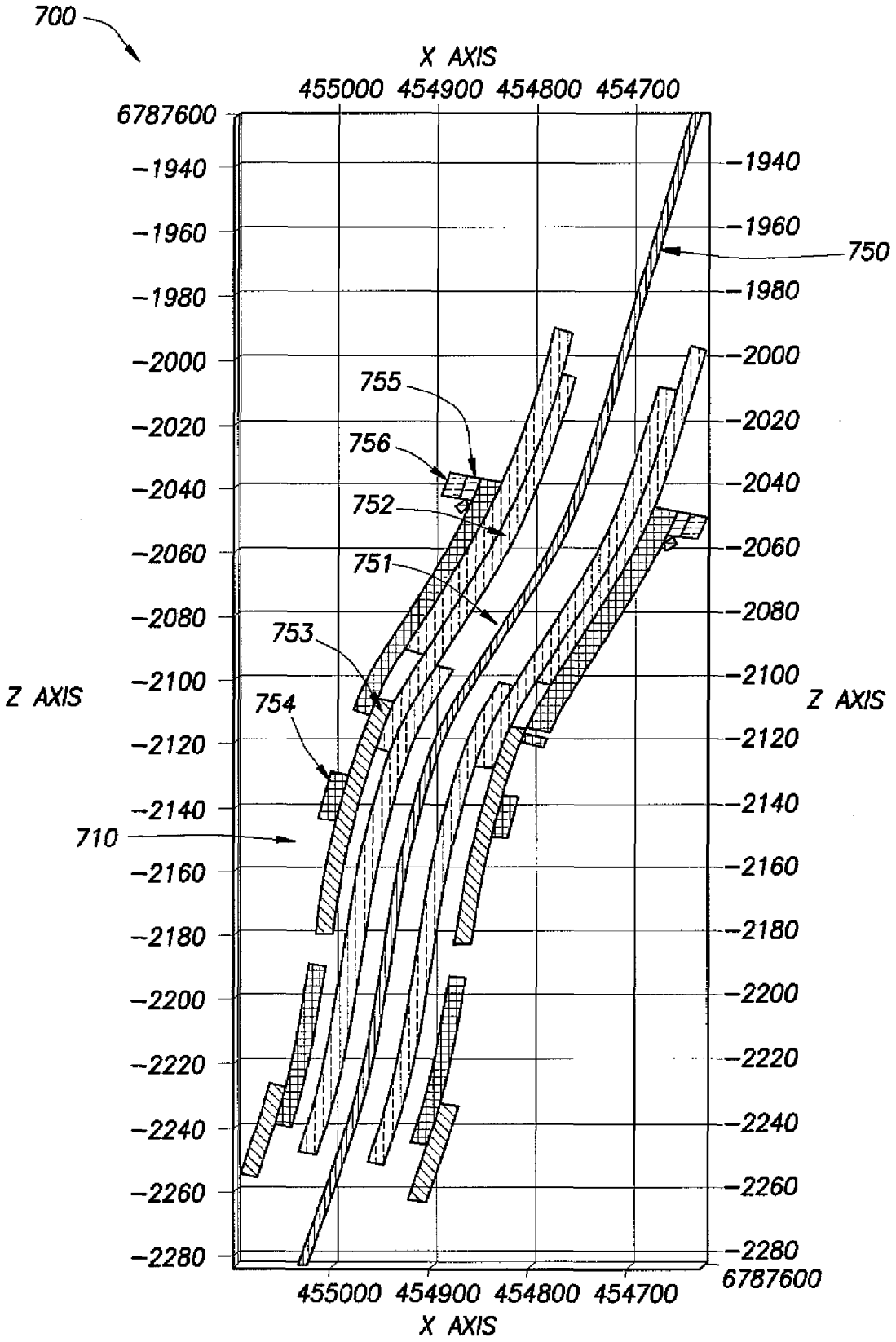

FIG. 7 shows a screen shot showing a display (700) of a wellbore image A (750) and icons representing oilfield events configured as a billboard-like object (710), as described in reference to FIG. 6A above. The display (700) may be provided by the data rendering unit performing the rendering algorithm calculation, as described in reference to FIG. 6B above. Each of the icons representing oilfield events are placed in one of the tracks running parallel to the wellbore image A (750), such as track a through track f (751-756), on the billboard-like object (710). Track a through track f are arranged in a similar fashion as described in FIG. 6B above. The dividing lines between tracks are disabled as shown in FIG. 7 as opposed to the earlier exemplary screen shot. Further, track a (751) is shown with no icon placed inside, while track b (752) and track c (753) are each is shown with only one icon placed inside and having available space for placing additional icons. Such a display is shown as a result of removing certain icons previously placed in track a through track c (751-753) based on a selective adjustment when a user reselects the portion of a large number of oilfield events for display as described in reference to FIG. 4 above.

Figure 8:
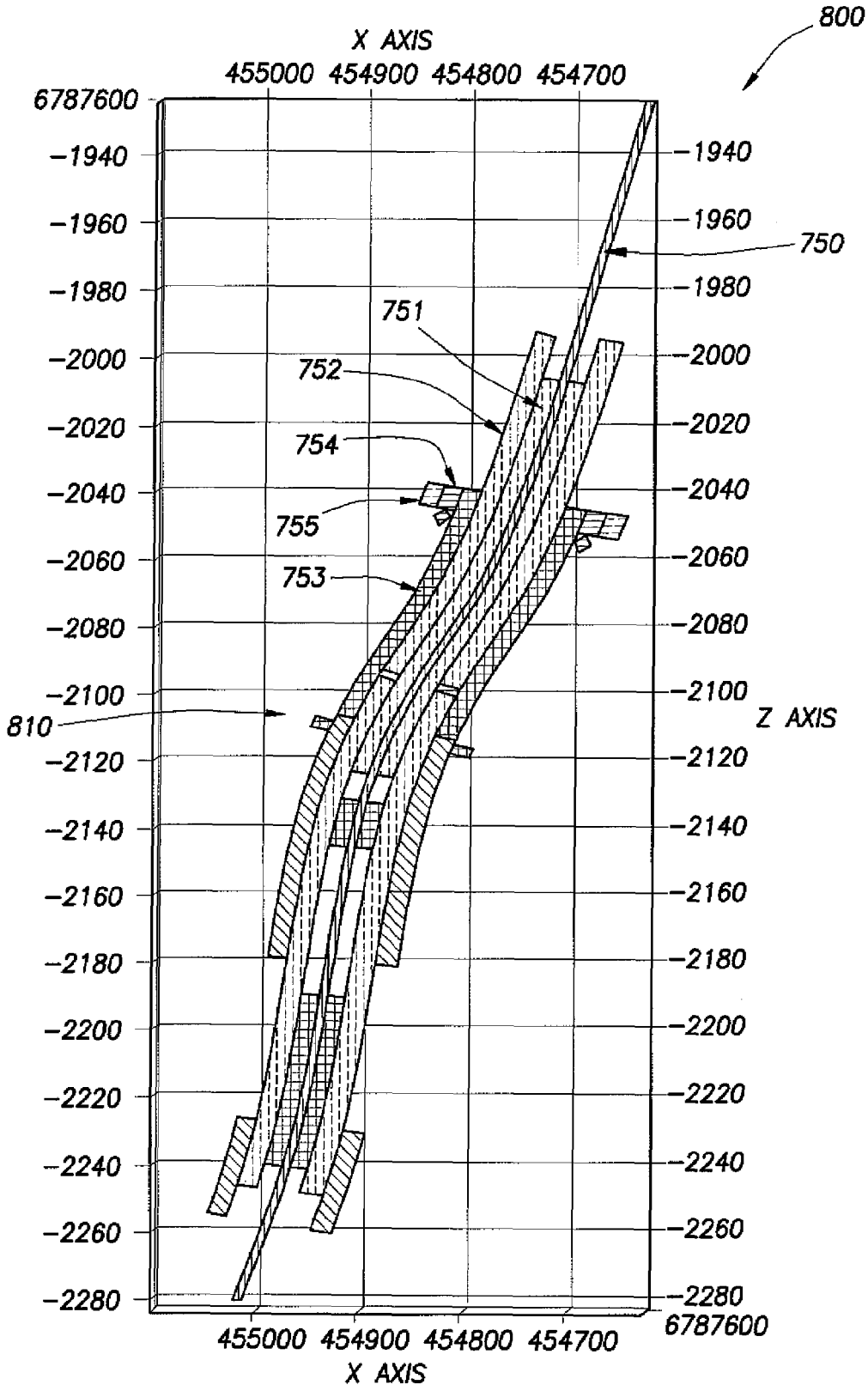

FIG. 8 shows a screen shot showing a display (800) of the wellbore image A (750) and the same icons representing oilfield events as described in FIG. 7 above. Here, the icons representing oilfield events are configured as a compacted billboard-like object (810). The display (800) is shown as a result of the data rendering unit (436) performing re-calculation of the rendering algorithm in real-time for optimizing the clarity of the display.

Figure 9B:
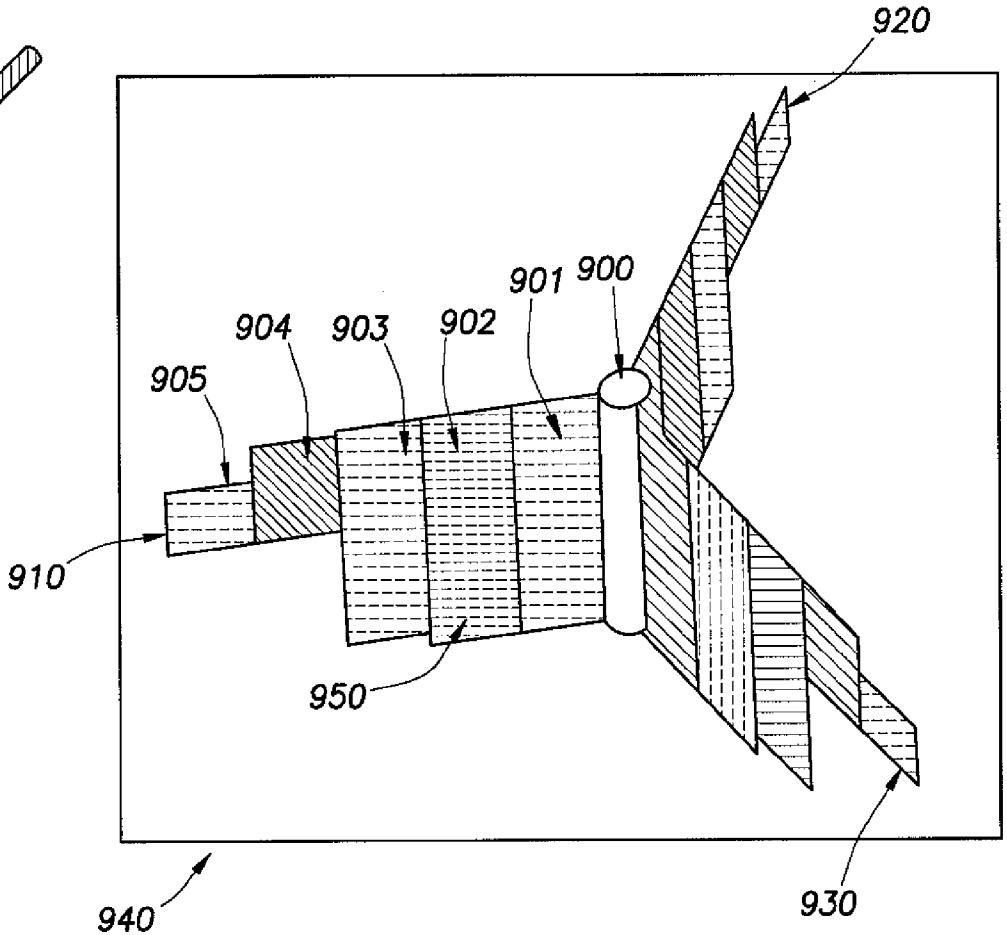
Figure 9A:
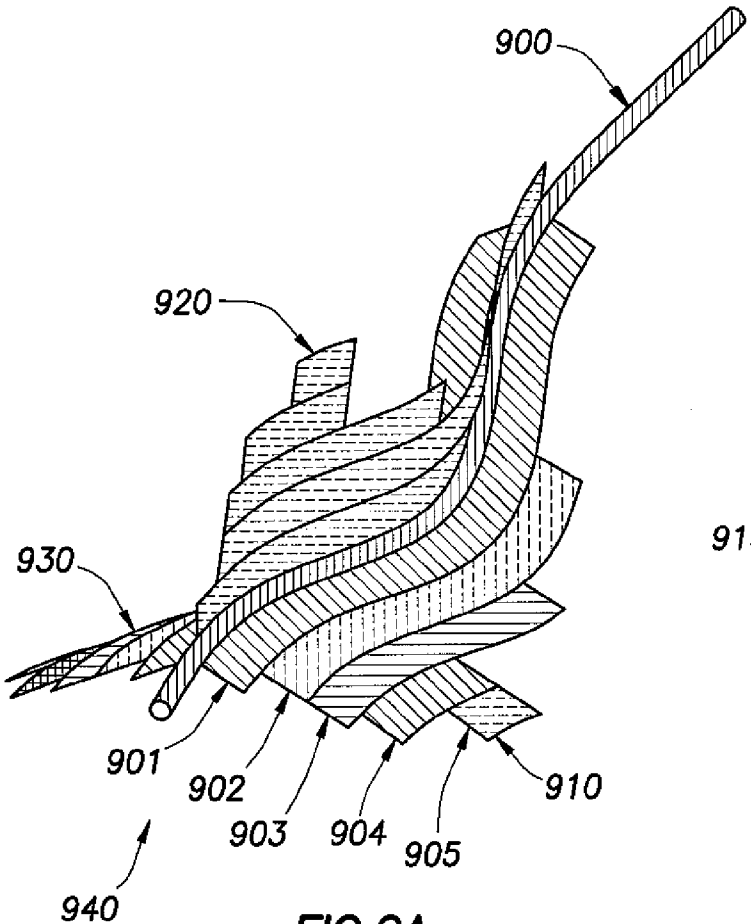

FIG. 9A shows an exemplary representation of multiple oilfield events in the 3D display (940). FIG. 9A includes wellbore image C (900) with three fin-like objects attached along the wellbore trajectory. Here, fin X (910), fin Y (920) and fin Z (930) together forms a variation of the billboard-like object described above. Fin X (910) includes various tracks (901-905). In the example shown in FIG. 9A, each of the various tracks (901-905) includes one oilfield event icon placed inside. Fin Y (920) and Fin Z (930) are replicas of Fin X (910) and are oriented at different angles around the wellbore trajectory so as to be visible to a user as viewing angle of the 3D display (940) is changed.

FIG. 9B shows a detail view of a section of the exemplary representation of multiple oilfield events of FIG. 9A with the same references indicated for perspective.

FIG. 10A shows a schematic diagram with an example of a user viewing a 3D display representing multiple oilfield events using multiple fin arrangement. Here, user A (1001) views a 3D view A (1130) along a viewing direction A (1110). The 3D view A (1130) is represented as a cross section view A (1120) to illustrate the benefit of multiple fin arrangement. One skilled in the art will appreciate that as viewing direction A (1110) changes through various viewing angles relative to the cross section view A (1120), oilfield event icons placed on fin X (1010), fin Y (1020), or fin Z (1030) may be visible to the user A (1001).

FIG. 10B shows a schematic diagram with another example of a user viewing a 3D display representing multiple oilfield events using a rotating billboard arrangement. Here, user B (1002) views a 3D view B (1330) along viewing direction B (1310) and viewing direction C (1510). The 3D view B (1330) is represented as a cross section view B (1320) to illustrate the benefit of a rotating billboard arrangement. The cross section view B (1320) includes a duplicate set of wellbore image B (1200) and rotating billboard (1220) corresponding to the viewing direction B (1310) and the viewing direction C (1510), respectively for illustration purpose.

As described in reference to FIG. 6A above, the data rendering unit (436) may be provided with a mechanism to orient the icons representing the oilfield events in the 3D display according to an adjusted viewing angle. For example, the icons representing the oilfield events may be oriented by rotating the rotating billboard (1220) using the wellbore image B (1200) as an axis of rotation. As such, the rotating billboard (1220) is always presented to the user B (1002) at a viewing angle that allows a full view of the icons representing the oilfield events placed on the rotating billboard regardless of the viewing direction.

Figure 11:
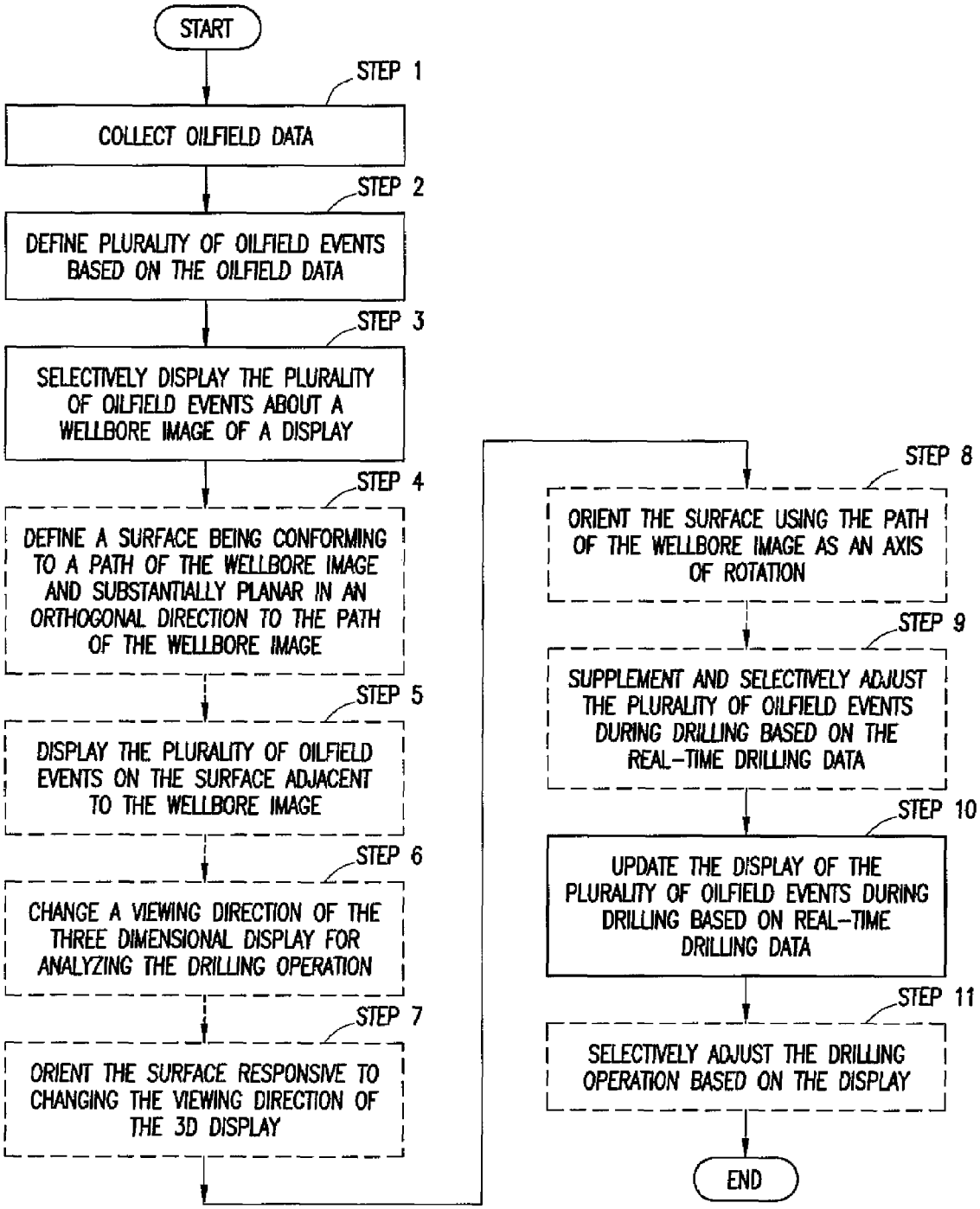

FIG. 11 shows a flow chart of a method for performing a drilling operation of an oilfield. The method may be performed using, for example, the system of FIG. 4. The method may involve collecting oilfield data, with a portion of the oilfield data being real-time drilling data generated from the oilfield during drilling (Step 1), defining a plurality of oilfield events based on the oilfield data (Step 2), selectively displaying the plurality of oilfield events about a wellbore image of a display (Step 3), and updating the display of the plurality of oilfield events during drilling based on the real-time drilling data (Step 10). The method may optionally involve supplementing or selectively adjusting the plurality of oilfield events during drilling based on the real-time drilling data (Step 9), and selectively adjusting the drilling operation based on the display (Step 11).

The display may optionally be a 3D display, in which case the method may involve defining the surface conforming to a path of the wellbore image and substantially planar in an orthogonal direction to the path of the wellbore image (Step 4), displaying the plurality of oilfield events on a surface adjacent to the wellbore image (Step 5), changing a viewing direction of the three dimensional display for analyzing the drilling operation (Step 6), orienting the surface responsive to changing the viewing direction of the 3D display (Step 7) and orienting the surface using the path of the wellbore image as an axis of rotation (Step 8).

The oilfield data may be collected (Step 1) from a variety of sources. As discussed with respect to FIGS. 3 and 4, data may be generated by sensors at the wellsite or from other sources. The data may be transferred to the modeling tool (408 in FIG. 4). The data may be transferred directly to the modeling tool, or transferred to the modeling tool via at least one of the servers (406 in FIG. 4). The data is then generally received by the interface of the modeling tool.

The oilfield data may be defined into oilfield events (Step 2) by the processing modules (442 in FIG. 4). Some oilfield events may represent real-time oilfield data acquired during drilling for monitoring risks and other drilling events of the drilling operation. Other oilfield events may be generated from historic data compiled at neighboring wellsites as lesson learned or best practice references. A portion of the oilfield events is selected for display about an image of the wellbore trajectory (Step 3) to support decision making in the drilling operation. Images of the earth model representing subterranean formations and reservoirs surrounding the wellbore trajectory may also be selected for display. The display may be provided by the data rendering unit (436 in FIG. 4) in the modeling tool and presented to a user at the display unit (416 in FIG. 4) in the surface unit.

As the drilling tool advances into the subterranean formation, a large number of oilfield events are being added from the increasing amount of oilfield data acquired by the downhole sensors (Step 9). The user may also, from time to time, select (or re-select) the portion of oilfield events most relevant for display (Step 9). The data rendering module may recalculate the rendering algorithm to adjust the placement of the oilfield events display in real-time (Step 10). Desired course of action may be determined based on the updated display to adjust the drilling operation (Step 11).

While these real-time oilfield events are being updated to the display (Step 10), a user may, from time to time, change the viewing direction of the display to observe the wellbore trajectory penetrating the formation toward the reservoir without being obscured. The display of oilfield events may be configured to be on a surface adjacent to the wellbore image (Step 5) where the surface may be a billboard-like object attached to the image of the wellbore trajectory (Step 4). The surface may also be arranged as multiple fin structure to allow the oilfield events to be visible from all viewing directions. Alternatively, the billboard-like object may be rotated around the wellbore trajectory image to present a full view of the oilfield events to the user as the viewing angle is changed (Steps 7, 8). The billboard-like object may be rotated according to the changing viewing direction by the data rendering unit.

FIG. 12 shows a flow chart of a method for performing a drilling operation of an oilfield. The method may be performed using, for example, the system of FIG. 4.

The method involves collecting oilfield data, with a portion of the oilfield data being real-time drilling data generated from the oilfield during drilling (Step 21), defining a plurality of oilfield events based on the oilfield data (Step 22), formatting a display based on a portion of the plurality of oilfield events selected for the display (Step 23), and selectively reformatting the display in real-time responsive to supplementing the selected portion of the plurality of oilfield events or selectively adjusting the selected portion of the plurality of oilfield events (Step 24).

The method may optionally involve including a first oilfield event in the portion of the plurality of oilfield events selected for the display, where the first oilfield event is defined based on the real-time drilling data or historic data (Step 25), formatting the display based on a ranking of the first oilfield event in the selected portion of the plurality of oilfield events (Step 27), and reformatting a portion of the display corresponding to the first oilfield event in real-time responsive to adding a second oilfield event to the selected portion of the plurality of oilfield events or removing a third oilfield event from the selected portion of the plurality of oilfield events (Step 28).

The method may also optionally involve displaying each of the plurality of oilfield events as an icon on a surface adjacent to a wellbore image of the display (Step 26), defining each icon based on an attribute of each of the plurality of oilfield events, where the attribute includes start depth, end depth, type, category, severity, or probability (Step 29), placing each icon on the surface based on a ranking of the plurality of oilfield events, wherein the ranking determines placement proximity of each icon relative to the wellbore image (Step 30), defining location, length, color, or pattern of each icon based on the attribute of each of the plurality of oilfield events (Step 31), allocating a plurality of tracks on the surface, the plurality of tracks substantially parallel to a path of the wellbore image (Step 32), and placing each icon into one of the plurality of tracks without overlapping (Step 33).

The oilfield data may be collected (Step 21) from a variety of sources. As discussed with respect to FIGS. 3 and 4, data may be generated by sensors at the wellsite or from other sources. The oilfield data may be defined into oilfield events (Step 22) by the processing modules (442 in FIG. 4). A portion of the oilfield events is selected for display (Step 23). For example, a user may, from time to time, add an oilfield event (e.g., representing a lesson learned or a best practice) to be displayed or remove an oilfield event that is no longer relevant. The data rendering unit (436 in FIG. 4) may re-calculate the rendering algorithm in real-time to re-format the display by creating a space for the added oilfield event or by re-using spaces made available from the removal of an oilfield event (Step 24). The result is a compacted format that improves the clarity of the display.

For example, a first oilfield event may be added to the display (700) of FIG. 7 from real-time oilfield data or historic data (Step 25). The first oilfield event may be placed in track b (752). A second oilfield event may have been removed from the display and left a vacant spot in track a (751). The display (700) is reformatted in real-time (Step 28) by the data rendering unit (436) to compact the billboard-like object (710) into the compacted billboard object (810). The first oilfield event, for example having the longest expanse of a certain depth, is placed in the track a (751) using a rendering algorithm based on ranking of the expanse of certain depths (Step 27).

The oilfield events may be defined in a variety of formats, such as the WITSML or the like. The oilfield events may have attributes such as start depth, end depth, depth extend, type, category, severity, or probability (Steps 29). The oilfield events may be represented in a display by icons having locations, length, color, or patterns defined corresponding to the oilfield attributes (Steps 31). The oilfield events may be ranked in an order for placement purpose in formatting the display (Step 30). The icons representing the oilfield events may be displayed on a surface adjacent to a wellbore image (Step 26) and placed in parallel tracks along the wellbore trajectory without overlapping each other (Steps 32, 33).

As the adjustments are made, the process may be repeated. New oilfield data is collected during the drilling process. The drilling data may be monitored and new drilling plans generated and compared to the earth plan. Further adjustments may be implemented as desired.

The steps of the method are depicted in a specific order. However, it will be appreciated that the steps may be performed simultaneously or in a different order or sequence. Further, throughout the method, the oilfield data may be displayed, the canvases may provide a variety of displays for the various data collected and/or generated, and the display may have user inputs that permit users to tailor the oilfield data collection, processing and display.

It will be understood from the foregoing description that various modifications and changes may be made in the preferred and alternative embodiments of the present invention without departing from its true spirit. For example, the method may be performed in a different sequence, and the components provided may be integrated or separate.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of performing a drilling operation for an oilfield, the oilfield having drilling system for advancing a drilling tool into a subterranean formation, comprising:

collecting oilfield data, a portion of the oilfield data being real-time drilling data generated from the oilfield during drilling;

defining a plurality of oilfield events based on the oilfield data;

selectively displaying the plurality of oilfield events in proximity of a wellbore image of a display; and updating the display of the plurality of oilfield events during drilling based on the real-time drilling data.

2. The method of claim 1, further comprising:

selectively manipulating the oilfield data for real-time analysis according to a defined configuration;

comparing the real-time drilling data with oilfield predictions based on the defined configuration; and selectively adjusting the drilling operation based on the comparison.

3. The method of claim 1, further comprising:

performing at least one selected from a group consisting of supplementing and selectively adjusting the plurality of oilfield events during drilling based on the real-time drilling data.

4. The method of claim 1, further comprising:

selectively adjusting the drilling operation based on the display.

5. The method of claim 1, wherein the display is a three dimensional display and the method further comprises:

displaying the plurality of oilfield events on a surface adjacent to the wellbore image, changing a viewing direction of the three dimensional display for analyzing the drilling operation; and orienting the surface responsive to changing the viewing direction of the 3D display.

6. The method of claim 5, further comprising:

defining the surface being conforming to a path of the wellbore image and substantially planar in an orthogonal direction to the path of the wellbore image; and orienting the surface using the path of the wellbore image as an axis of rotation.

7. A method of performing a drilling operation for an oilfield, the oilfield having drilling system for advancing a drilling tool into a subterranean formation, comprising:

collecting oilfield data, a portion of the oilfield data being real-time drilling data generated from the oilfield during drilling;

defining a plurality of oilfield events based on the oilfield data;

formatting a display based on a portion of the plurality of oilfield events selected for the display; and selectively reformatting the display in real-time responsive to at least one selected from a group consisting of supplementing the selected portion of the plurality of oilfield events and selectively adjusting the selected portion of the plurality of oilfield events.

8. The method of claim 7, further comprising:

including a first oilfield event in the portion of the plurality of oilfield events selected for the display, wherein the first oilfield event is defined based on at least one selected from a group consisting of the real-time drilling data and historic data;

formatting the display based on a ranking of the first oilfield event in the selected portion of the plurality of oilfield events; and reformatting a portion of the display corresponding to the first oilfield event in real-time responsive to the at least one selected from the group consisting of adding a second oilfield event to the selected portion of the plurality of oilfield events and removing a third oilfield event from the selected portion of the plurality of oilfield events.

9. The method of claim 7, wherein formatting the display comprises:

displaying each of the plurality of oilfield events as an icon on a surface adjacent to a wellbore image of the display;

defining each icon based on an attribute of each of the plurality of oilfield events, wherein the attribute comprises at least one selected from a group consisting of start depth, end depth, type, category, severity, and probability; and placing each icon on the surface based on a ranking of the plurality of oilfield events, wherein the ranking determines placement proximity of each icon relative to the wellbore image.

10. The method of claim 9, wherein formatting the display further comprises:

defining at least one selected from a group consisting of location, length, color, and pattern of each icon based on the attribute of each of the plurality of oilfield events;

allocating a plurality of tracks on the surface, the plurality of tracks substantially parallel to a path of the wellbore image; and placing each icon into one of the plurality of tracks without overlapping.

11. A computer readable medium, embodying instructions executable by a computer to perform method steps for performing a drilling operation for an oilfield, the oilfield having drilling system for advancing a drilling tool into a subterranean formation, the instructions comprising functionality for:

collecting oilfield data, at least a portion of the oilfield data being generated from a wellsite of the oilfield;

defining a plurality of oilfield events based on the oilfield data;

selectively displaying the plurality of oilfield events in proximity of a wellbore image of a display; and updating the display of the plurality of oilfield events during drilling based on the real- time drilling data.

12. The computer readable medium of claim 11, the instructions further comprising functionality for:

generating an adjusted drilling plan based on the comparison; and implementing the adjusted drilling plan at the wellsite.

13. A system for performing a drilling operation for an oilfield, the oilfield having a subterranean formation, comprising:

a surface unit for collecting oilfield data, a portion of the oilfield data being real-time drilling data generated from the oilfield during drilling, the surface unit having a display unit for presenting a display;

a modeling tool operatively linked to the surface unit, the modeling tool comprising:

a processing module for defining a plurality of oilfield events based on the oilfield data; and a data rendering unit for providing the display and selectively adjusting the display in real time during drilling based on the real-time drilling data, wherein the display represents the plurality of oilfield events in proximity of a wellbore image;

and a drilling system operatively linked to the surface unit for advancing a drilling tool into the subterranean formation, wherein the drilling system is selectively adjusted responsive to the display.

14. The system of claim 13, the modeling tool further comprising:

a plurality of formatting modules for selectively formatting the oilfield data according to a real-time configuration; and a plurality of processing modules for selectively analyzing the oilfield databased on the real-time configuration.

* * * * *